US008963791B1

(12) United States Patent
Edwards et al.

(10) Patent No.: US 8,963,791 B1
(45) Date of Patent: Feb. 24, 2015

(54) DUAL-BAND FEED HORN

(71) Applicant: L-3 Communications Corp., New York, NY (US)

(72) Inventors: Richard G. Edwards, Salt Lake City, UT (US); Rory K. Sorensen, Salt Lake City, UT (US); Joseph M. Baird, Salt Lake City, UT (US)

(73) Assignee: L-3 Communications Corp., New York, NY (US)

( * ) Notice: Subject to any disclaimer, the term of this patent is extended or adjusted under 35 U.S.C. 154(b) by 266 days.

(21) Appl. No.: 13/628,473

(22) Filed: Sep. 27, 2012

(51) Int. Cl.
*H01Q 13/00* (2006.01)

(52) U.S. Cl.
USPC ..... 343/786; 343/781 P; 343/781 R

(58) Field of Classification Search
CPC ..... H01Q 13/00; H01Q 13/02; H01Q 15/14
USPC ..... 343/786, 781 R, 781 P
See application file for complete search history.

(56) References Cited

U.S. PATENT DOCUMENTS

| | | | | |
|---|---|---|---|---|
| 6,396,453 | B2 * | 5/2002 | Amyotte et al. | 343/786 |
| 7,091,923 | B2 * | 8/2006 | del Rio Bocio et al. | 343/786 |
| 2002/0167453 | A1 * | 11/2002 | Kung et al. | 343/786 |
| 2005/0104794 | A1 | 5/2005 | Rao et al. | |
| 2010/0060546 | A1 | 3/2010 | Robson et al. | |
| 2012/0139807 | A1 | 6/2012 | Simon et al. | |

OTHER PUBLICATIONS

Johansson, "A Gauss-Laguerre Analysis of the Dual-Mode ('Potter') Horn," 4th Int'l Symposium on Space Terahertz Technology (1993), pp. 134-148.

Yassin et al., "A High Performance Horn for Large Format Focal Plane Arrays," 18th Int'l Symposium on Space Terahertz Technology (2007), pp. 199-210.

U.S. Appl. No. 13/628,534, filed Sep. 27, 2012, Edwards et al.

* cited by examiner

*Primary Examiner* — Hoang V Nguyen
(74) *Attorney, Agent, or Firm* — Kirton McConkie

(57) ABSTRACT

A radio frequency (RF) horn can include an interior surface with an inner geometry comprising irregular, aperiodic corrugations and/or undulations. The pattern of the inner geometry can excite higher order modes simultaneously in two RF signals each at a different frequency that combine with fundamental modes of the signals to produce substantially Gaussian profiles of the two signals at the output aperture of the horn. Even though the signals are at different frequencies, the illumination pattern of both signals on a reflector antenna at which the horn is directed can be substantially the same.

24 Claims, 15 Drawing Sheets

DUAL-BAND FEED HORN

This application is related to US patent application Ser. No. 13/628,534 entitled "Tri-Band Feed Horn", which is filed on the same day as the instant application.

BACKGROUND

The invention relates to radio frequency (RF) feed horns such as can be used, for example, with reflector antenna systems. It can be advantageous to operate reflector antenna systems at two or more different frequency bands. For example, one frequency band can be for transmitting RF signals, and another frequency band can be for receiving RF signals. Current reflector antennas operating at two separated frequency bands generally produce an illumination pattern on the main reflector antenna that may differ in size by, for example, about fifty percent due to the frequency difference between the signals of the two frequency bands. This size difference may result in a decrease in efficiency at one or both frequency bands. Attempts to address this problem have included inserting a dielectric rod or other dielectric material into the horn. However, while the dielectric can ameliorate the illumination pattern problem to a certain extent, it may also limit the power handling capabilities of the horn. Accordingly, it would be beneficial to provide a horn that addresses illumination pattern efficiency, power handling challenges, and/or provides other benefits.

SUMMARY

In some embodiments of the invention, a radio frequency horn comprises an input, an output aperture, and an inner wall surface between the input and the output aperture. The inner wall surface can have an inner geometry that can comprise irregular, aperiodic corrugations and/or undulations. The pattern of the inner geometry can excite from a first signal at a first frequency introduced at the input, additional modes that combine with a fundamental mode of the first signal such that the first signal has a substantially Gaussian beam profile at the output aperture of the horn. The pattern of the inner geometry can also excite from a second signal at a second frequency different than the first frequency introduced at the input additional modes that combine with a fundamental mode of the second signal such that the second signal has a substantially Gaussian beam profile at the output aperture.

In some embodiments of the invention, a method of projecting a first signal and a second signal onto a radio frequency reflector antenna can include introducing into a horn a first RF signal at a first frequency, and exciting with an inner geometry comprising irregular, aperiodic corrugations and/or undulations on an interior surface of the horn additional modes of the first signal that combine with a fundamental mode of the first signal such that the first signal has a substantially Gaussian beam profile at an output aperture of the horn. The method can also comprise introducing into the horn a second RF signal at a second frequency different than the first frequency, and exciting with the inner geometry of the horn additional modes of the second RF signal that combine with a fundamental mode of the second signal such that the second signal has a substantially Gaussian beam profile at the output aperture of the horn.

In some embodiments of the invention, a computer implemented method of designing an inner geometry of a multi-band horn can include receiving at a computer system at least two frequency bands to be directed by a horn. The method can also include designing with a computer system using computational electromagnetics and one or more optimization processes, an inner geometry of a horn that configures each of the beams directed by the horn, of the two or more frequency bands, to have at least approximately a set of target characteristics, including having a Gaussian aperture profile pattern and producing a fixed illumination pattern on a reflector at which the horn is directed.

DETAILED DESCRIPTION OF EXEMPLARY EMBODIMENTS

Figure 1:
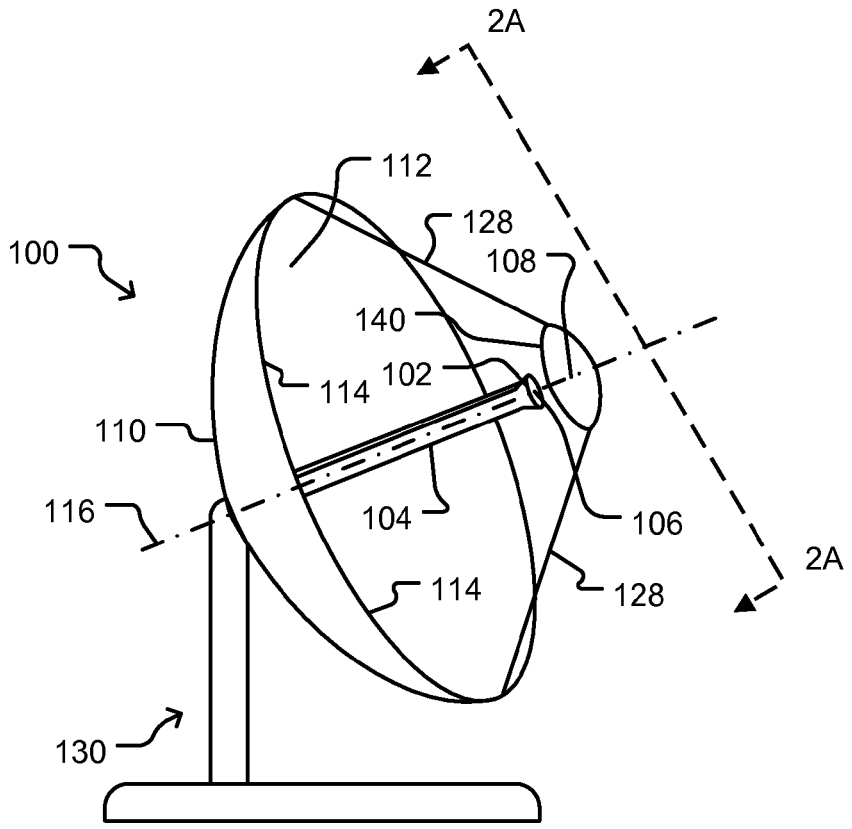
FIG. 1 illustrates an example of a reflector antenna system according to some embodiments of the invention.

This specification describes exemplary embodiments and applications of the invention. The invention, however, is not limited to these exemplary embodiments and applications or to the manner in which the exemplary embodiments and applications operate or are described herein. Moreover, the Figures may show simplified or partial views, and the dimensions of elements in the Figures may be exaggerated or otherwise not in proportion for clarity. In addition, the singular forms "a," "an," and "the" include plural referents unless the context clearly dictates otherwise. Thus, for example, reference to a surface includes reference to one or more surfaces. In addition, where reference is made to a list of elements (e.g., elements a, b, and c), such reference is intended to include any one of the listed elements by itself, any combination of less than all of the listed elements, and/or a combination of all of the listed elements.

The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. As a particular example, in RF applications, the beam profile of an RF signal is a substantially Gaussian profile even if the profile is not a mathematically precise Gaussian profile but nevertheless is a close approximation. A quasi-Gaussian profile can be considered substantially Gaussian.

The term "geometry" refers to the shape or form of a surface or solid. For example, the inner geometry of a horn can refer to the shape or form of the interior surface(s) of the horn. Particularly, such an inner geometry can include one or more corrugations and/or undulations, including protrusions, recesses, convex surfaces, concave surfaces, and the like.

The "fundamental mode" of an RF signal in a horn is the mode of the signal in which the signal was input into the horn. The fundamental mode of a signal thus does not include modes generated by discontinuities in the horn while the signal is propagating through the horn, which are referred to herein as "additional modes" or "higher order modes."

The embodiments of the invention illustrated and discussed herein relate to horns for receiving and outputting radio frequency (RF) signals. The horns, antennas, signals, beams, etc. illustrated and discussed herein are RF structures, elements, signals, beams, etc. regardless of whether the designation RF is expressly stated.

Embodiments of the invention include a multi-band RF feed horn that can produce high aperture efficiency in separated frequency bands. Embodiments of the invention also include techniques for designing an inner geometry of a multi-band horn that can produce high aperture efficiency in separated frequency bands. These techniques can be implemented in a variety of computer systems.

Figure 2A:
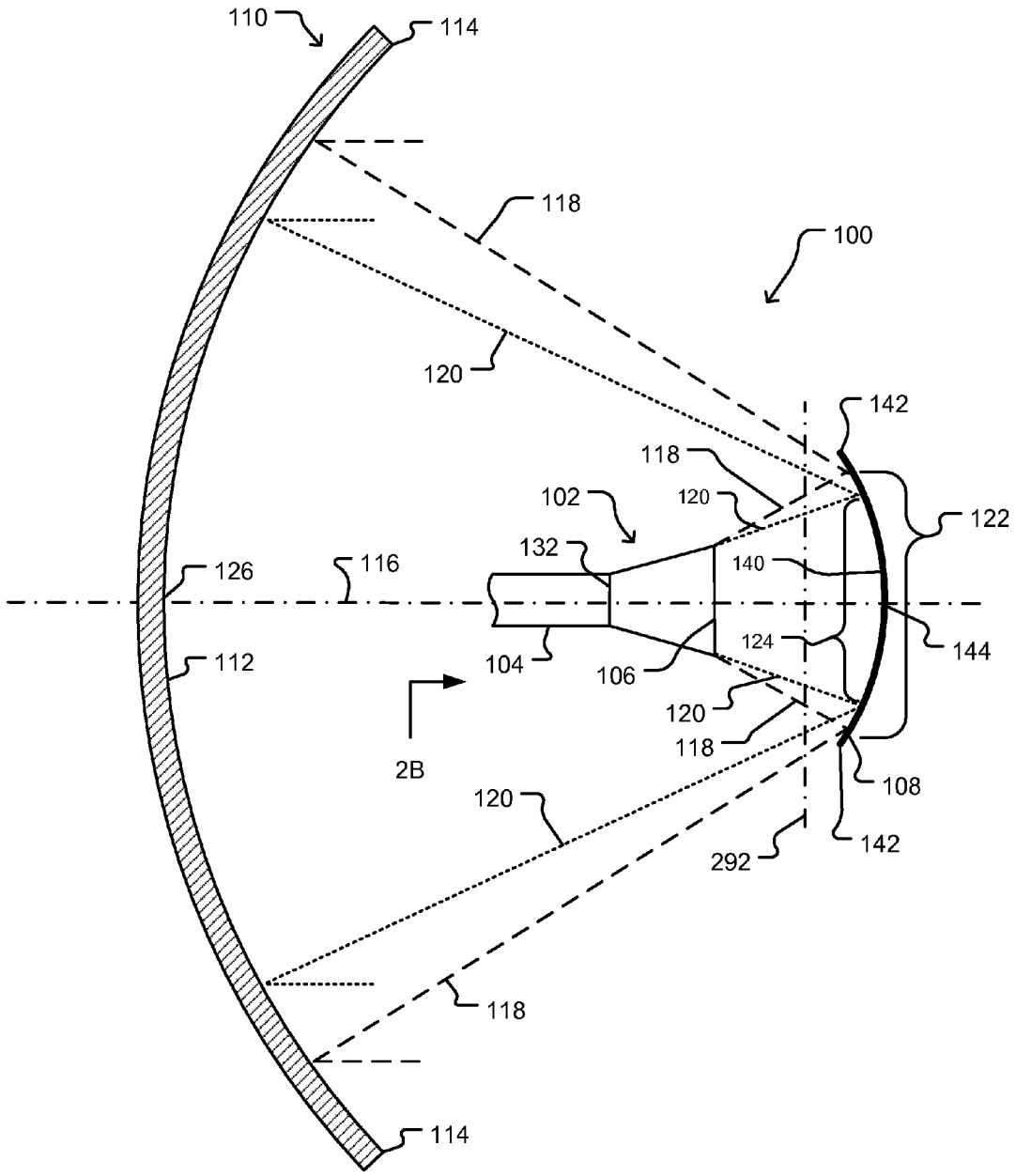
FIG. 2A shows a partial cross-sectioned, side view of the reflector antenna system of FIG. 1.

FIG. 1 illustrates an example of an RF reflector antenna system 100 with an example of a dual-band RF feed horn 102 according to some embodiments of the invention. FIG. 2A illustrates a partial cross-sectioned side view of the antenna system 100, and FIG. 2B illustrates illumination patterns 122 and 124 of RF signals 118 and 120 on the face 112 of the intermediate reflector 108.

As shown in FIG. 1, the RF reflector antenna system 100 can comprise an RF signal feed 104, an RF feed horn antenna 102, an intermediate RF reflector antenna 108, and a main RF reflector antenna 110. Support structures 128 can secure the intermediate reflector 108 in place, and a stand 130 can support the main reflector 110. A central axis 116 can be an axis that passes through a center point 144 of the intermediate reflector 108, and a center point 126 (see FIGS. 2A and 2B) of the main reflector 110. The center point 126 can be the center of the face 112 of the main reflector 110, which has edges 114.

The signal feed 104 can be connected to an input 132 of the horn 102, and the output 106 of the horn 102 can be directed at the intermediate reflector 108, which can be directed at the main reflector 110 as shown. Although illustrated in FIG. 1 as a Gregorian configuration (i.e., the intermediate reflector 108 is concave with respect to the main reflector 110), the reflector antenna system 100 can be in other configurations such as a Cassegrain configuration (i.e., the intermediate reflector 108 is convex with respect to the main reflector 110). Other alternative configurations include an axial or front feed configuration in which the main reflector 110 replaces the intermediate reflector 108 in FIGS. 1-2A. In such a configuration, the horn 102 is directed at the main reflector 110, and there is not an intermediate reflector 108. For ease of discussion and illustration, however, the antenna system 100 is discussed and described herein with regard to the configuration shown in FIG. 1. It is to be understood, however, that all discussions herein regarding illumination patterns on the intermediate reflector 108 apply to the main reflector 110 with face 112, edges 114, and center point 126 when the antenna system 100 is configured as discussed above in an axial or front feed configuration in which the main reflector 110 takes the place of the intermediate reflector 108 in any of the depictions shown in the Figures.

Figure 2B:
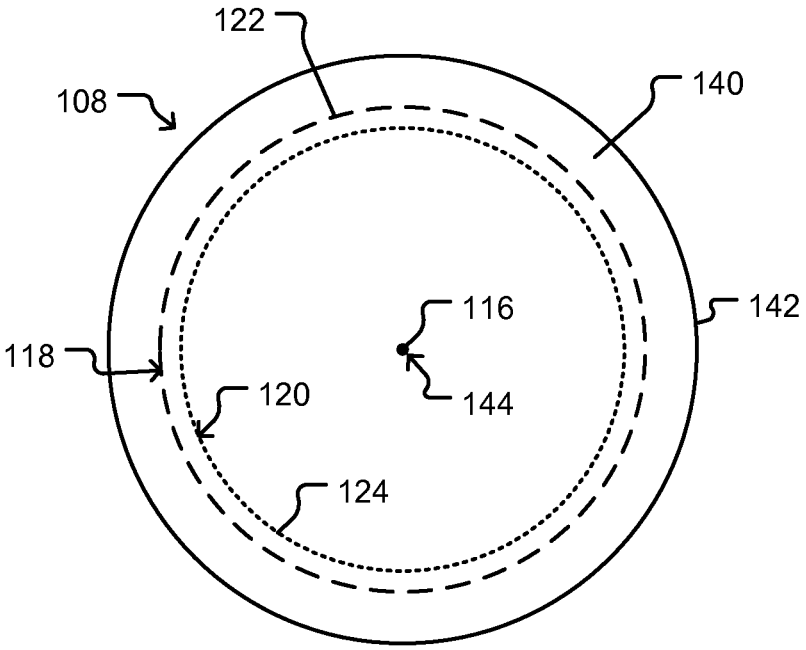
FIG. 2B shows the face of the intermediate reflector of FIG. 1.

Referring to FIGS. 1, 2A, and 2B, an RF signal provided through the signal feed 104 to an input 132 of the horn 102 can radiate from the horn output 106 to the intermediate reflector 108. The intermediate reflector 108 can reflect the RF signal to the main reflector 110, which can reflect the RF signal into free space as a transmitted RF signal. For example, the reflector antenna 110 can reflect the RF signal toward an intended target (e.g., a satellite, a communications station, an aircraft, or the like).

An incoming RF signal (e.g., from a satellite, communications station, aircraft, or the like) can travel an opposite path. That is, an incoming RF signal can reflect off of the main reflector 110 to the intermediate reflector 108, which can reflect the incoming RF signal into the horn output 106. The incoming RF signal can then exit the input 132 of the horn 102 and enter the signal feed 104.

The intermediate reflector 108 and the main reflector 110 can be parabolic, dish type antennas such as are known in the field. As will be seen, however, the horn 102 can be configured to transmit and/or receive efficiently RF signals at two separated frequencies. That is, the horn 102 can operate at two different frequency bands while exhibiting high aperture efficiency.

As shown in FIGS. 2A and 2B, for example, a first RF signal 118 can correspond to a first illumination pattern 122 on the face 140 of the intermediate reflector 108, and a second RF signal 120 can correspond to a second illumination pattern 124 on the face 140 of the intermediate reflector 108. As noted above, the illumination patterns 122 and 124 can be reflected from the intermediate reflector 108 to the main reflector 110. The first RF signal 118 can have a first frequency that is within a first frequency band, and the second RF signal 120 can have a second frequency that is within a second frequency band.

The first frequency band can be, for example, for transmitting, and the first RF signal 118 can accordingly be provided from the signal feed 104 to the horn 102. The first RF signal 118 can exit the output 106 of the horn 102 and reflect off of the face 140 of the intermediate reflector 108 to the face 112 of the main reflector 110. The second frequency band can be, for example, for receiving, and the second RF signal 120 can accordingly be received at the main reflector 110 and be reflected to the intermediate reflector 108. As shown in FIG. 2B, the second signal 120 can be reflected off of the intermediate reflector 108 into the output 106 of the horn 102. The second signal 120 can then exit the input 132 of the horn 102 into the signal feed 104.

It is noted that the directions of the first signal 118 and the second signal 120 in the above discussion and as illustrated in the drawings are examples only. For example, both signals 118 and 120 can be transmitted signals or both can be received signals. Regardless of the direction (transmit or receive) of the first RF signal 118, the characteristics of the corresponding illumination pattern 122 on the face 140 of the intermediate reflector 108 are the same. Similarly, the characteristics of the second illumination pattern 122 on the face 140 of the intermediate reflector 108 are the same regardless of the direction (transmit or receive) of the second RF signal 120. For ease of discussion and illustration, the first RF signal 118, the second RF signal 120, the first illumination pattern 122, and the second illumination pattern 124 are herein discussed either without reference to direction (transmit or receive) or as transmit signals. Where, however, the first RF signal 118, the second RF signal 120, the first illumination pattern 122, and the second illumination pattern 124 are discussed with regard to transmit, such discussion includes the receive direction as well.

The horn 102 can be configured such that the illumination patterns 122 and 124 on the face 140 of the intermediate reflector 108 have one or more desired characteristics despite the fact that the RF signals 118 and 120 have different frequencies and/or are in different frequency bands. For example, the first RF signal 118 and the second RF signal 120 can be separated by at least 1 megahertz (MHz), 5 MHz, 10 MHz, 20 MHz, 50 MHz, 100 MHz, 500 MHz, or more. In fact, in some embodiments, the two frequencies can be separated by 1 gigahertz (GHz), 5 GHz, 10 GHz, or more. As another example, the first RF signal 118 and the second RF signal 120 can each be in a different one of the following frequency bands: the L-band (one to two gigahertz RF signals), S-band (two to four gigahertz RF signals), C-band (four to eight gigahertz RF signals), X-band (eight to twelve gigahertz RF signals), Ku-band (twelve to eighteen gigahertz RF signals), K-band (eighteen to twenty-seven gigahertz RF signals), Ka-band (twenty-seven to thirty-three gigahertz RF signals), Q-band (thirty-three to fifty gigahertz RF signals), V-band (fifty to seventy-one gigahertz RF signals), E-band (seventy-one to eighty-six gigahertz), and W-band (eighty-six to one-hundred-ten gigahertz RF signals). As another example, in various embodiments, the frequency of the first RF signal 118 can be at least forty percent (40%) of the frequency of the second RF signal 120, at least fifty percent (50%) of the frequency of the second RF signal 120, at least sixty percent (60%) of the frequency of the second RF signal 120, at least seventy percent (70%) of the frequency of the second RF signal 120, or at least eighty percent (80%) of the frequency of the second RF signal 120. As yet another example, the different between the frequency of the first RF signal 118 and the frequency of the second RF signal 120 can be at least ten percent of the frequency of the first RF signal.

Characteristics of the illumination patterns 122 and 124 that can be achieved despite one or more of the foregoing differences in the frequencies of the first RF signal 118 and the second RF signal 120 can include that the first illumination pattern 122 and the second illumination pattern 124 can be substantially the same size on the face 140 of the intermediate reflector 108. For example, the size of the first illumination pattern 122 can be within one percent (1%), two percent (2%), three percent (3%), four percent (4%), or five percent (5%) of the size of the second illumination pattern 124. As other examples, the size of the first illumination pattern 122 can be within ten percent (10%), fifteen percent (15%), or twenty percent (20%) of the size of the second illumination pattern 124.

Another characteristic of the illumination patterns 122 and 124 that can be achieved despite one or more of the foregoing differences in the frequencies of the first RF signal 118 and the second RF signal 120 can include that the first illumination pattern 122 and the second illumination pattern 124 can have substantially the same gain on the face 140 of the intermediate reflector 108. For example, the gain of the first illumination pattern 122 can be within one decibel (1 dB), two decibels (2 dB), three decibels (3 dB), or five decibels (5 dB) of the gain of the second illumination pattern 124.

Yet another example of a characteristic of the illumination patterns 122 and 124 that can be achieved despite one or more of the above-identified differences in the frequencies of the first RF signal 118 and the second RF signal 120 can include one or both of the illumination patterns 122 and 124 having a predetermined normalized gain at the edge 142 of the intermediate reflector 108 relative to the gain at the center 144 of the face 104 of the intermediate reflector 108. For example, the normalized gain at the edge 142 of the intermediate reflector 108 relative to the gain at the center 144 of the intermediate reflector 108 for one or both of the illumination patterns 122 and 124 can be, in some embodiments, within minus five decibels (−5 dB), minus eight decibels (−8 dB), minus ten decibels (−10 dB), minus twelve decibels (−12 dB), or minus fifteen decibels (−15 dB) of the gain at the center 144 of the face 140 of the intermediate reflector 108.

Still another example of a characteristic of the illumination patterns 122 and 124 that can be achieved despite one or more of the above-identified differences in the frequencies of the first RF signal 118 and the second RF signal 120 can include the illumination patterns 122 and 124 both having a predetermined, uniform shape. For example, the shapes of both of the illumination patterns 122 and 124 on the face 140 of the intermediate reflector 108 can be substantially circular, oval, or the like.

One or more of the foregoing characteristics of the illumination patterns 122 and 124 can be achieved despite the one or more of the above-identified differences in the frequencies of the first RF signal 118 and the second RF signal 120 by configuring the horn 102 to have an inner geometry that excites modes (e.g., higher order modes) in each of the RF signals 118 and 120 that combine with the fundamental mode of the RF signal 118, 120 to produce a substantially Gaussian or quasi-Gaussian beam profile pattern generally at or near the output 106 of the horn 102.

Figure 3A:
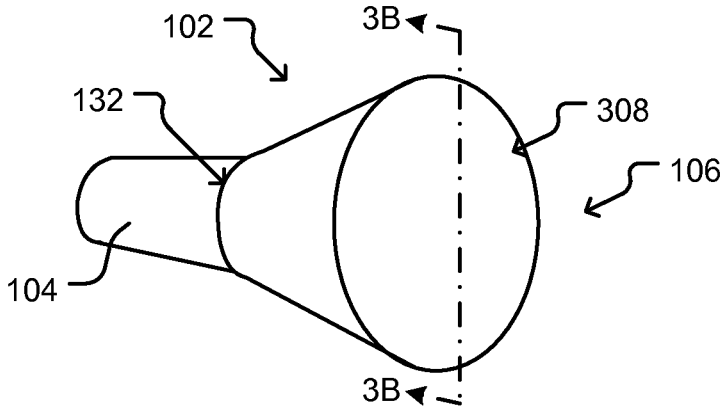
FIG. 3A illustrates the dual-band feed horn of the reflector antenna system of FIG. 1 according to some embodiments of the invention.
Figure 3B:
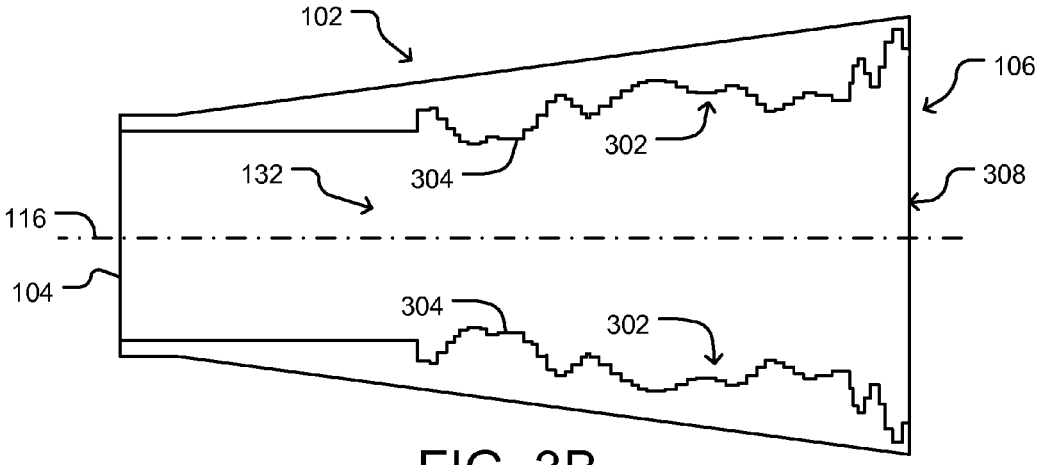
FIG. 3B is a cross-sectioned, side view of the horn of FIG. 3A.
Figure 4:
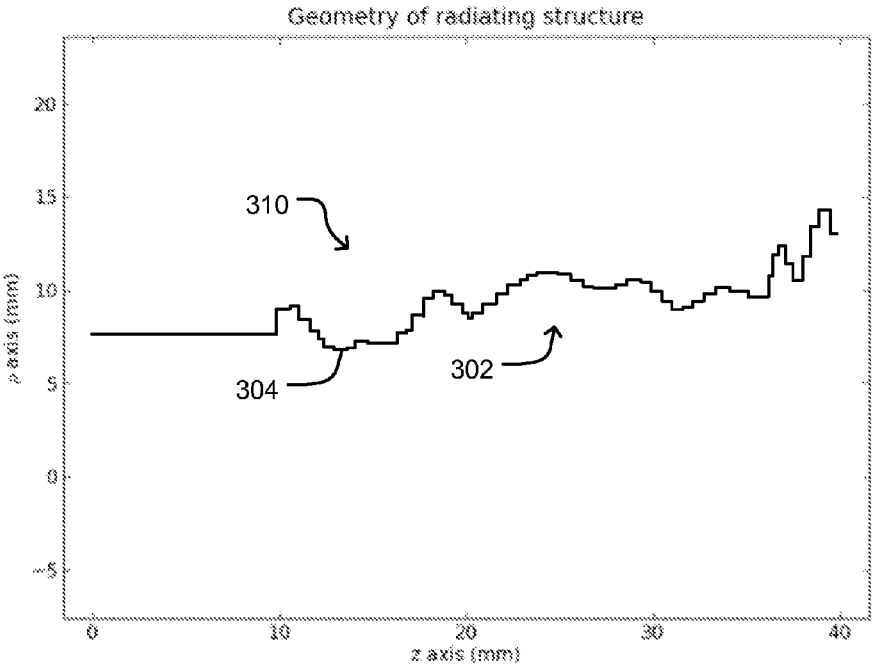
FIG. 4 shows a two-dimensional profile of an inner geometry of the horn of FIGS. 3A and 3B according to some embodiments of the invention.

FIGS. 3A, 3B, and 4 illustrate an example in which the horn 102 is configured to have such an inner geometry 302. FIG. 3A illustrates an example of the horn 102, and FIG. 3B illustrates a cross sectioned, side view of the horn 102 of FIG. 3A. Although the horn 102 is illustrated as conical, the horn 102 can alternatively have other shapes including square, rectangular, pyramidal, or the like. As shown in FIG. 3B, the inner geometry 302 can comprise a series of irregular features 304 that extend into and/or out of the inner wall of the horn 102. The features 304 can be located on an inner wall of the horn 102 between the input 132 and the output aperture 308 (the output 106) of the horn 102.

FIG. 4 illustrates a representative profile 310 of the inner geometry 302 of the horn 102. As shown, the profile 310 is plotted on a vertical, p, axis that represents a distance away from a central axis 116 of the horn 102 (see FIG. 3B). The horizontal (z) axis (in FIG. 4) represents a distance along the central axis 116 of the horn 102. In circular horn embodiments, such as are shown in FIGS. 3A and 3B, the profile is rotated about the central axis 1116 of the horn 102.

The profile 310 of the inner geometry 302 of the horn 102 can include a series of irregular and/or aperiodic features 304 along the length of the interior surface(s) of the horn 102 between the input 132 and the output aperture 308 (which corresponds to the output 106) of the horn 102. The profile 310 can thus be irregular and/or aperiodic. The features 304 can be corrugations, undulations, protrusions, recesses, convex surfaces, concave surfaces, wave or wavelike forms, teeth, extensions, indentations, or the like. The series of features 304 can be shaped, sized, and/or otherwise configured to: (1) excite modes (e.g., higher order modes) from the fundamental mode of the first RF signal 118 in the horn 102 that combine with the fundamental mode of the first RF signal 118 in the horn 102 to produce a substantially Gaussian or quasi-Gaussian beam profile of the first RF signal 118 at or near the output aperture 308 (which coincides with the output 106) of the horn 102; and (2) excite modes (e.g., higher order modes) from the fundamental mode of the second RF signal 120 in the horn 102 that combine with the fundamental mode of the first RF signal 118 in the horn 102 to produce a substantially Gaussian or quasi-Gaussian beam profile of the second RF signal 120 at or near the output aperture 308 of the horn 102. The profile 310 thus causes both the first RF signal 118 and the second RF signal 120 to have a substantially Gaussian or quasi-Gaussian profile at or near the output aperture 308 of the horn 102.

The beam profile of the RF signals 118 and 120 will continue as substantially Gaussian or quasi-Gaussian beams as the signals 118 and 120 propagate from the output 106 of the horn 102. In the example illustrated in FIGS. 1 and 2A, the intermediate reflector 108 reflects the signals 118 and 120 to the main reflector 110. The beams of the signals 118 and 120 from the output 106 of the horn 102 to the intermediate reflector 108 can thus have a substantially Gaussian or quasi-Gaussian profile. The illumination patterns 122 and 124 on the face 140 of the intermediate reflector 108 can thus have a substantially Gaussian or quasi-Gaussian profile.

Figure 5A:
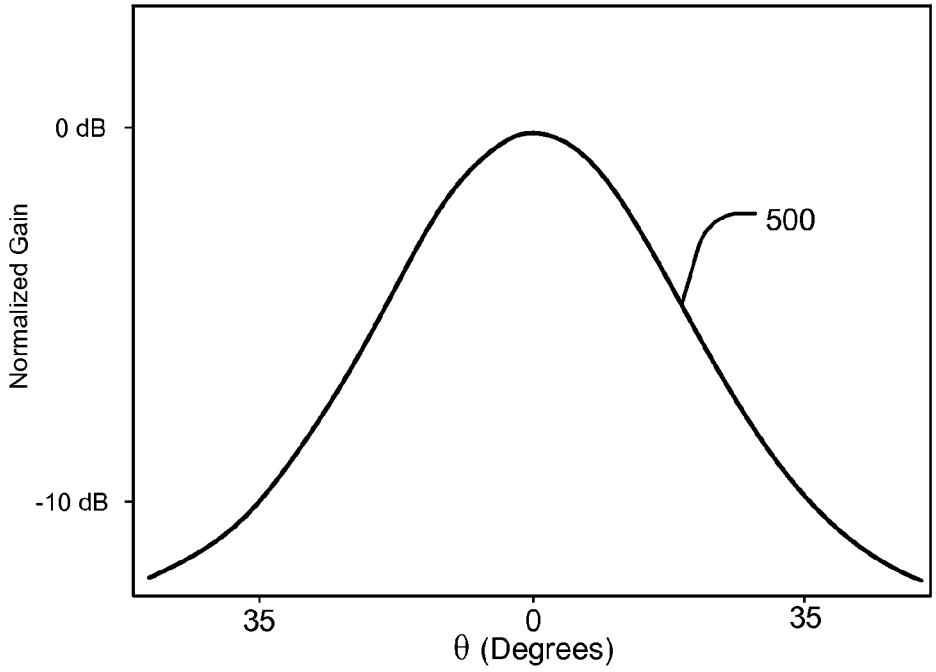
FIG. 5A is an example of a two-dimensional graphical representation of a Gaussian profile pattern of RF signals from the horn of the reflector antenna system of FIG. 1 at an output plane that is perpendicular to the axis of the horn according to some embodiments of the invention.
Figure 5B:
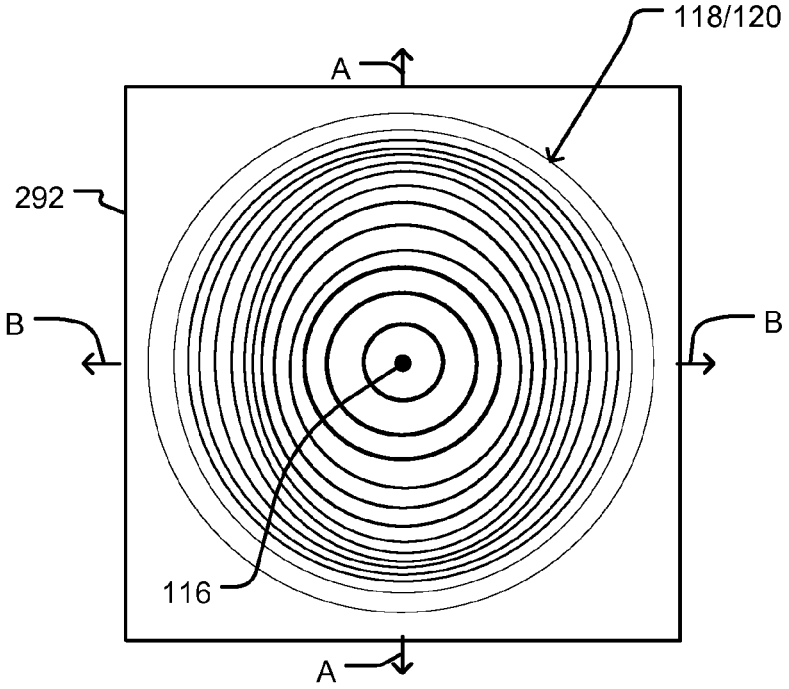
FIG. 5B is a three-dimensional graphical representation of the Gaussian profile pattern of FIG. 5A at the output plane that is perpendicular to the axis of the horn.

FIGS. 5A and 5B illustrate examples of Gaussian characteristics of the RF signals 118 and 120 in an output plane 292 (see FIG. 2A) that is perpendicular to the axis 116 and disposed between the output 106 of the horn 102 and the intermediate reflector 108. The output plane 292 is thus in and out of the page in FIG. 2A.

Turning first to FIG. 5A, a two dimensional gain profile of the RF signals 118 and 120 at the output plane 292 (see FIG. 2A) is shown. The vertical axis in FIG. 5A includes normalized gain relative to the maximum gain of the RF signals 118 and 120 at the output plane 292. As shown, the maximum gain can be present at or near the central axis 116. The horizontal axis presents locations along the output plane 292 in terms of the angle θ of the location relative to the central axis 116, wherein the angle θ is measured from the axis 116 at output 106 of the horn 102 to the output plane 292. The depicted line 500 shown in FIG. 5A illustrates normalized gain in the form of a substantially Gaussian curve. This curve indicates that the gain of the RF signals 118 and 120 is higher where the central axis 116 passes through the output plane 292 (which corresponds to zero degrees from the axis 116) and decreases in a generally Gaussian pattern as the angle from the axis 116 increases. Consistent with a substantially Gaussian pattern, the relatively constant high gain area of the RF signals 118 and 120 at the output plane 292 in an area around the axis 116 is referred to as the spot. In practice, such a Gaussian profile can reduce side lobes and corresponding energy loss.

FIG. 5B shows a front view of the output plane 292, and a three-dimensional gain profile of the Gaussian or quasi-Gaussian illumination pattern of the RF signals 118 and 120 at the output plane 292, which can also be the pattern of the illumination patterns 122 and 124 on the face 140 of the intermediate reflector 108. The gain profile is shown in elevation lines, with thicker lines (shown generally closer to the axis 116) representing higher gains and thinner lines (shown generally farther from the axis 116) representing lower gains. Each line can represent a step in the elevation or degree of gain. Thus, as shown, the RF signals 118 and 120 can include a high gain spot near the central axis 116, which tapers off with distance from the axis 116.

In some instances, a cross section of the three-dimensional Gaussian gain profile of FIG. 5B can be the two-dimensional Gaussian gain profile shown in FIG. 5A. For example, when taken along lines A-A or B-B, the cross section can result in the Gaussian curve of FIG. 5A. That is, the beam profiles of the RF signals 118 and 120 projected from the output 106 of the horn 102 can have a substantially Gaussian of quasi-Gaussian pattern at the output plane 292 at at least two cross sections A-A and B-B, which can be perpendicular as shown in FIG. 5B or otherwise not-parallel. For example, the cross-section B-B can instead be rotated, for example, about forty-five degrees or more from the cross section A-A.

The horn 102 can be entirely air filled and thus have no dielectric material within the interior of the horn 102, including no dielectric rod or lining. Without dielectrics, the horn 102 can operate at high power levels, such as up to kilowatt (kW) levels (e.g., at least 1 kW, 5 kWs, or higher) without burning up.

Figure 6:
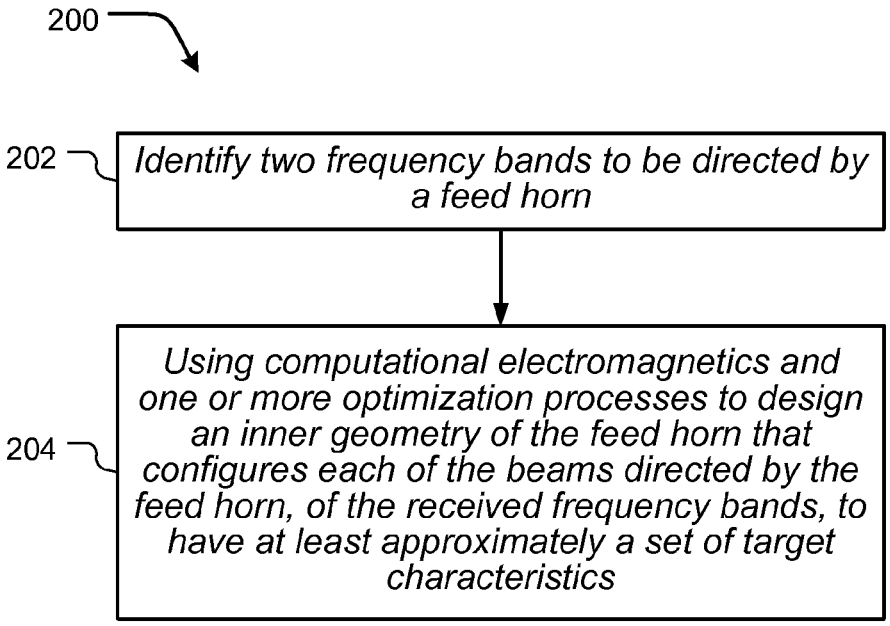
FIG. 6 is a flowchart of a method of designing an inner geometry of a horn according to some embodiments of the invention.

Referring again to FIG. 4, the particular shape of the profile 310 can depend on the two frequencies of the first RF signal 118 and the second RF signal 120 or the two frequency bands in which the first RF signal 118 and the second RF signal 120 fall. The profile 310 can be designed using one or more computational electromagnetics techniques and/or one or more optimization processes. FIG. 6 illustrates an example of a method 200 of designing the profile 310. In some embodiments, the method 200 can be a computer implemented method performed by one or more computer systems. Non-limiting examples of computer systems are described below with reference to FIGS. 13 and 14.

In step 202 of the method 200, two frequency bands can be identified over which the horn is to operate. The two frequency bands can be bands that the first RF signal 118 and the second RF signal 120 fall into. For example, in some embodiments, the first RF signal 118 can have any frequency in a first of the two frequency bands identified at step 202, and the second RF signal 120 can have any frequency in a second of the two frequency bands identified at step 202. Regardless, in a computer implemented embodiment of method 200, these frequency bands can be received, via one or more input devices, from a user operating the one or more computer systems.

In step 204, the profile 310 of the inner geometry 302 of the horn 102 is designed. The profile 310 can be designed using one or more computational electromagnetics techniques and/ or one or more optimization processes. In some embodiments, these one or more computational electromagnetics techniques and/or one or more optimization processes can be used together.

Computational electromagnetics is the process of modeling the interaction of electromagnetic fields with physical objects, such as the inner geometry of the horn, and the environment. Computational electromagnetics can use approximations to Maxwell's equations to calculate the horn's 102 performance, capabilities, and electromagnetic wave propagation properties for a variety of possible profiles 310. Computational electromagnetics can thus be utilized to calculate the beam characteristics of the first RF signal 118 and the beam characteristics of the second RF signal 120 at or near the output aperture 308 for any number of different profiles 310 of the inner geometry 302 of the horn 102.

Non-limiting examples of computational electromagnetics techniques include mode matching (MM), finite-difference time-domain (FDTD), finite-integration time-domain (FITD), multi-resolution time-domain (MRTD), finite element method (FEM), and other known techniques. In various particular embodiments, the method 200 can use mode matching techniques. Mode matching can simulate electromagnetic propagation involving the decomposition of electromagnetic fields into a basic set of modes that exist in a cross section of the horn 102. These modes can be found by solving Maxwell's equations in each local cross-section. Mode matching can use scattering matrix technique to join different sections of the horn 102 and to model non-uniform structures.

In some embodiments, the computational electromagnetics technique(s) can be used in combination with one or more optimization processes and/or optimization algorithms (herein simply optimization processes) to optimize the internal horn geometry. Generally, the optimization processes can vary the profile 310 of the inner geometry 302 of the horn 102, which can be analyzed using one or more computational electromagnetics techniques. These processes and techniques can utilize the target characteristics of the illumination patterns 122 and 124 as optimization targets. Optimization can minimize discrepancies between these optimization targets and the calculated outputs of the one or more computational electromagnetics techniques. The optimizer can iterate through variations of the profile 310 of the inner geometry 302 until the beams at or near the output aperture 308 of the horn 102 of the first RF signal 118 at any frequency in the first frequency band (received at step 202) and the second RF signal 120 at any frequency in the second frequency band (received at step 202) are sufficiently Gaussian or quasi-Gaussian to achieve one or more of the characteristics, discussed above, of the illumination patterns 122 and 124 on the face 140 of the intermediate reflector 108.

Figure 7:
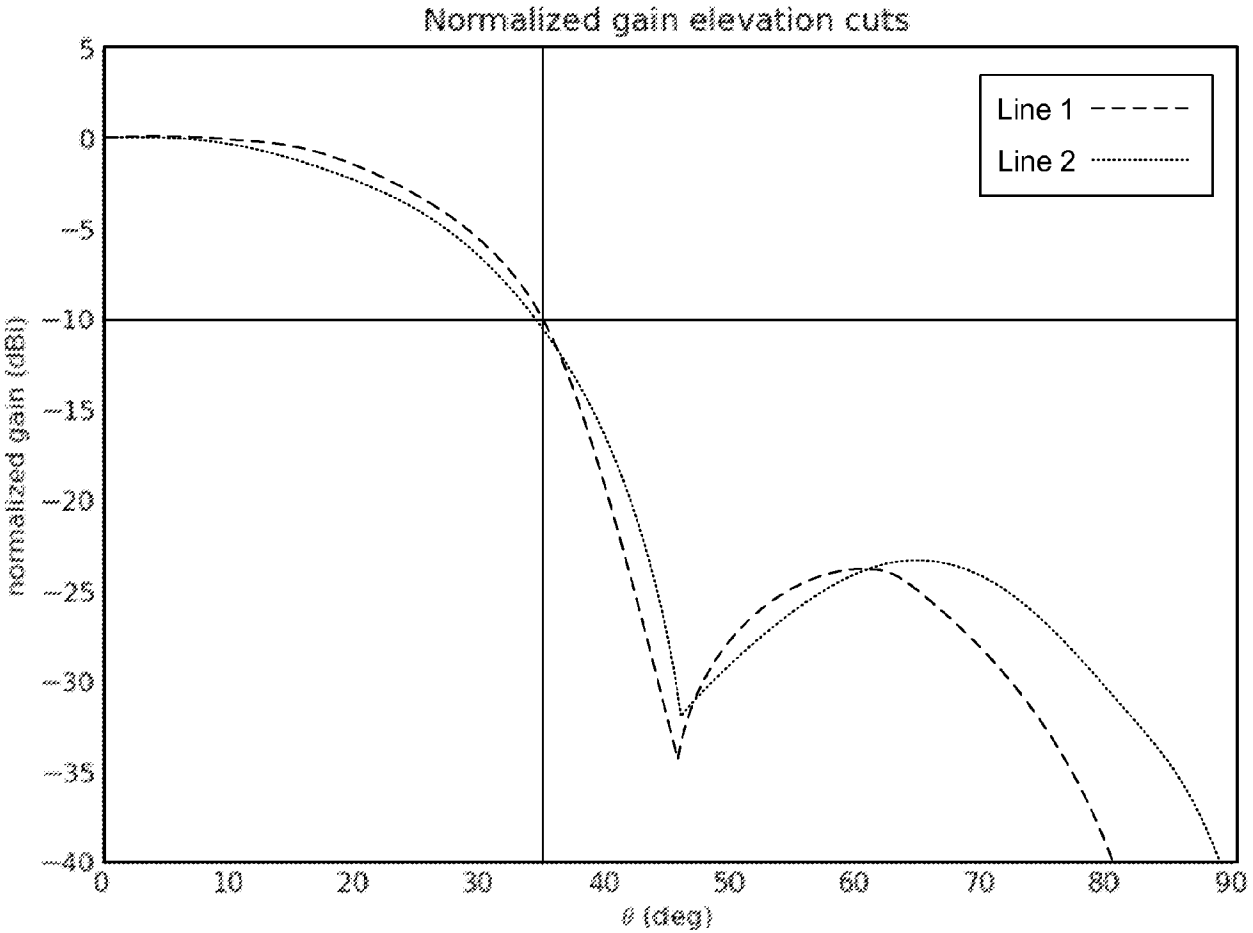
FIG. 7 is a two-dimensional graphical representation of beam profiles of RF signals in different frequency bands on the intermediate reflector of FIG. 1 according to some embodiments of the invention.

FIG. 7 illustrates such representative measurements that can be taken of the illumination patterns 122 and 124 on the face 140 of the intermediate reflector 108. In FIG. 7, the vertical axis represents normalized gain of the illumination patterns 122 and 124 on the face 140 of the intermediate reflector 108 along a cross section of the face 140. The horizontal axis represents location along the cross section as an angle from the central axis 116 taken from the center of the output 106 of the horn 102. The Line 1 and Line 2 represent normalized gain of the illumination patterns 122 and 124 on the face 140 of the intermediate reflector 108 along two cross sections of the main reflector 110 each of which goes through the center 144 of the intermediate reflector 108. Lines 1 and 2 illustrate that the normalized gain at about thirty-five degrees (which can correspond generally to the edge 142 of the intermediate reflector 108) can correspond to an approximately −10 dB normalized gain for both illumination patterns 122 and 124.

In some instances, where the horn is manufactured in a subtractive manufacturing process, such as milling or cutting, or when the horn is manufactured in a molding process, the optimization processes may limit the resulting geometries based on the manufacturability of the resulting horn. For example, the optimizing processes can be configured to avoid extreme changes in adjacent surface profiles that may result in sharp peaks and valley that are difficult to manufacture. However, some manufacturing processes, such as additive manufacturing processes, may reduce the need for such optimization restrictions.

Figure 8A:
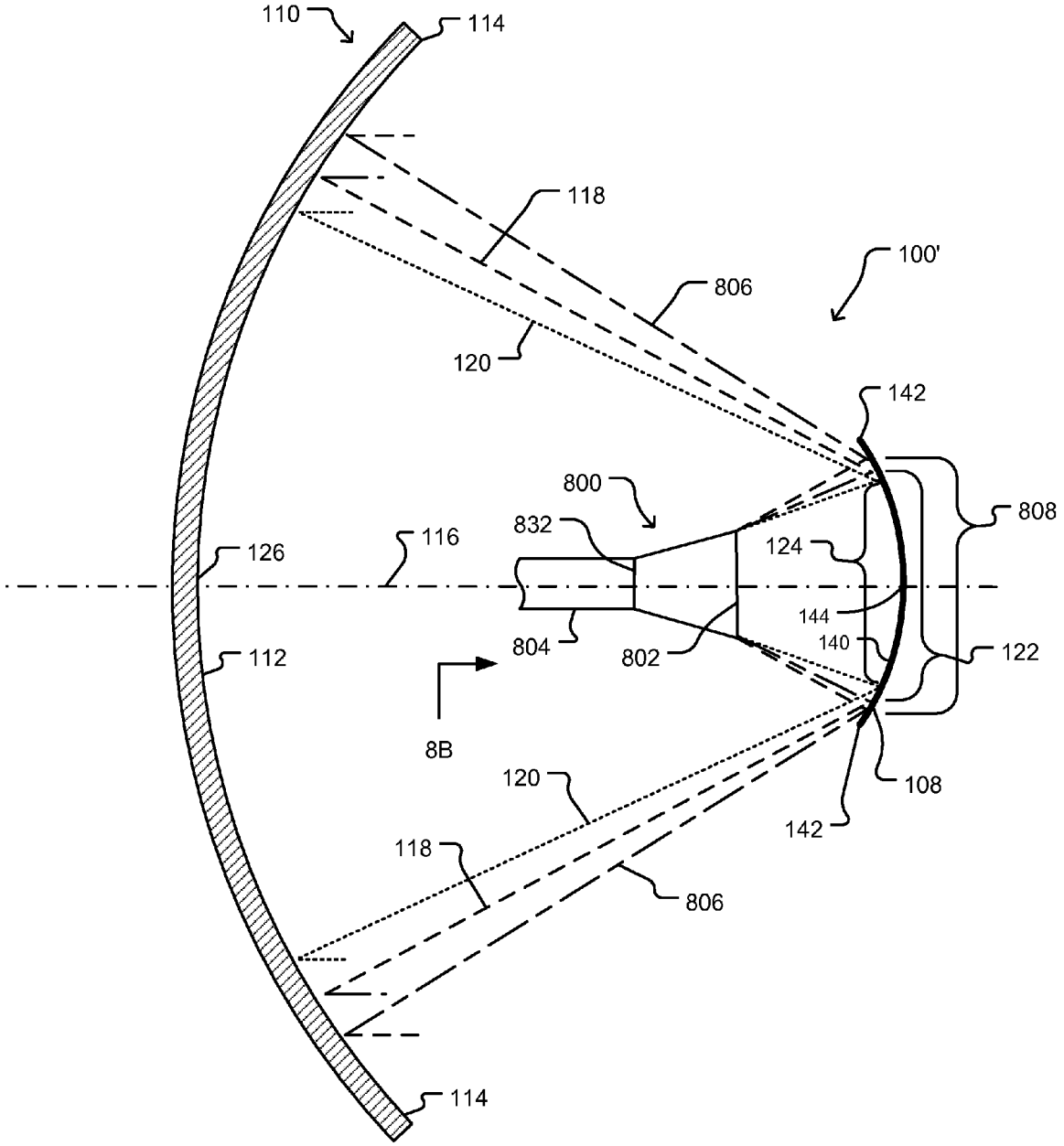
FIG. 8A shows a partial cross-sectioned, side view of the reflector antenna system of FIG. 1 configured with a tri-band feed horn according to some embodiments of the invention.

A dual band RF horn 102 has been illustrated in FIGS. 1-7 and discussed and described above. The principals of operation and design of the dual band RF horn 102, however, can be extended to design RF horns to operate similarly at more than two separated frequencies in more than two different bands. For example, such RF horns can be configured to operate at three, four, or more different frequencies in as many different bands. FIGS. 8A-12 illustrate an example in which the dual band horn 102 in the antenna system 100 of FIG. 1 is replaced with a tri-band horn 800 (which can be a coaxial horn) generally as shown in FIG. 8A (which is a side cross-section view of the system 100 similar to FIG. 2A except that the system 100' shown in FIG. 8A has a tri-band horn 800 instead of the dual band horn 102). The antenna system 100' of FIG. 8A can thus be generally the same as the system 100 shown in FIGS. 1 and 2A except that a tri-band horn 800 replaces the dual band horn 102. As also shown in FIG. 8A, a coaxial RF signal feed 804 can also replace the signal feed 104.

Figure 8B:
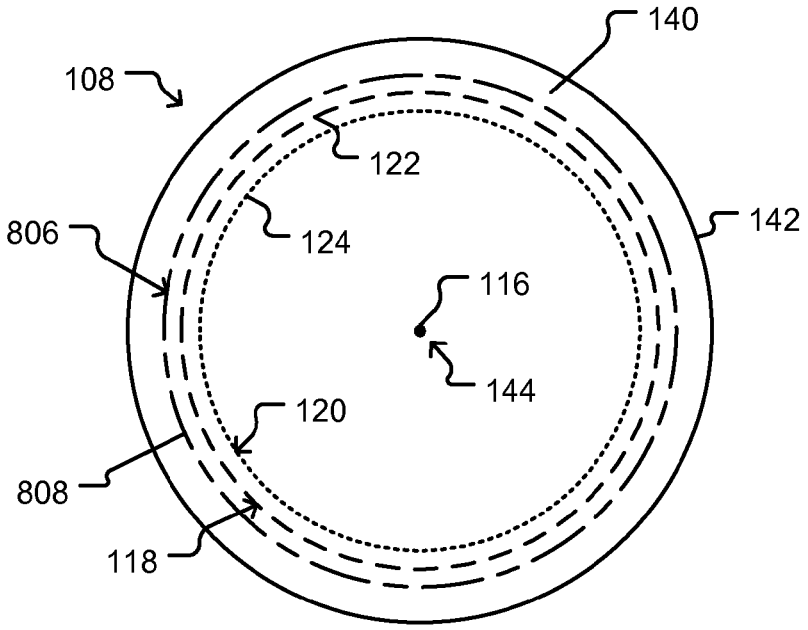
FIG. 8B shows the face of the intermediate reflector of FIG. 8A.

As shown in FIGS. 8A and 8B (which shows the face 140 of the intermediate reflector 108), the horn 800 can operate at three separated frequency bands. Three RF signals are illustrated in FIG. 8A: the first RF signal 118 (discussed above), the second RF signal 120 (discussed above), and a third RF signal 806. As discussed above, the first RF signal 118 can form a first illumination pattern 122 on the face 140 of the intermediate reflector 108, and the second RF signal 120 can form a second illumination pattern 124 on the face 112. As also discussed above, the first RF signal 118 can be in a first frequency band, and the second RF signal 120 can be in a second frequency band that is different than the first frequency band. Similarly, the third RF signal 806 can be in third frequency band that is different than the first frequency band and the second frequency band, and the third RF signal 806 can form a third illumination pattern 808 on the face 140 of the intermediate reflector 108. As generally discussed above with respect to the illumination patterns 122 and 124, the characteristics of the third illumination pattern 808 on the face 140 of the intermediate reflector 108 are the same regardless of the direction (transmit or receive) of the third RF signal 806. The third RF signal 806 and the third illumination pattern 808 will therefore hereinafter be discussed either without regard to the direction (transmit or receive) or where the third RF signal 806 is a transmit signal, but it is to be understood that the RF signal 806 can be, in any such discussion, alternatively a receive signal.

The tri-band horn 800 can be configured such that the illumination patterns 122, 124, and 808 have one or more desired characteristics despite the fact that the RF signals 118, 120, and 806 have different frequencies and/or are in different frequency bands. For example, each of the RF signals 118, 120, and 806 can be separated from the other two RF signals by at least 1 megahertz (MHz), 5 MHz, 10 MHz, 20 MHz, 50 MHz, 100 MHz, 500 MHz, or more. In fact, in some embodiments, each of the RF signals 118, 120, and 806 can be separated from the other two RF signals by 1 gigahertz (GHz), 5 GHz, 10 GHz, or more. As another example, each of the RF signals 118, 120, and 806 can be in a different one of the following frequency bands: the L-band (one to two gigahertz RF signals), S-band (two to four gigahertz RF signals), C-band (four to eight gigahertz RF signals), X-band (eight to twelve gigahertz RF signals), Ku-band (twelve to eighteen gigahertz RF signals), K-band (eighteen to twenty-seven gigahertz RF signals), Ka-band (twenty-seven to thirty-three gigahertz RF signals), Q-band (thirty-three to fifty gigahertz RF signals), V-band (fifty to seventy-one gigahertz RF signals), E-band (seventy-one to eighty-six gigahertz), and W-band (eighty-six to one-hundred-ten gigahertz RF signals). For example, in some embodiments, the first RF signal 118 can have any frequency in any first one of the foregoing bands, the second RF signal 120 can have any frequency in any second one of the foregoing bands, and the third RF signal 806 can have any frequency in any third one of the foregoing bands, wherein the first one, the second one, and the third one of the frequency bands are different bands.

As another example, in various embodiments, the difference between the highest and the lowest of the first RF signal 118, the second RF signal 120, and the third RF signal 806 can be sixty percent (60%) or less, fifty percent (50%) or less, forty percent (40%) or less, thirty percent (30%) or less, or twenty percent (20%) or less.

The tri-band horn 800 can be configured such that, despite the difference in frequencies of the RF signals 118, 120, and 806, the illumination patterns 122, 124, and 808 on the face 140 of the intermediate reflector 108 have one or more of the desired characteristics discussed above with respect to the horn 102.

For example, the illumination patterns 122, 124, and 806 can be substantially the same size on the face 140 of the intermediate reflector 108. For example, the size of each one of the illumination patterns 122, 124, and 808 can be within one percent (1%), two percent (2%), three percent (3%), four percent (4%), or five percent (5%) of the sizes of the other two illumination patterns. As other examples, the size of each of one the illumination patterns 118, 120, and 808 can be within ten percent (10%), fifteen percent (15%), or twenty percent (20%) of the sizes of the other two illumination patterns.

As another example, the illumination patterns 122, 124, and 808 can have substantially the same gain on the face 140 of the intermediate reflector 108. For example, the gain of each one of the illumination patterns 122, 124, and 808 can be within one decibel (1 dB), two decibels (2 dB), three decibels (3 dB), or five decibels (5 dB) of the gains of the other two illumination patterns.

As yet another example, each of the illumination patterns 122, 124, and 808 can have a predetermined normalized gain at the edge 142 of the intermediate reflector 108 relative to the gain at the center 144 of the intermediate reflector 108. For example, the normalized gain at the edge 142 of the intermediate reflector 108 relative to the gain at the center 144 of the intermediate reflector 108 for one, two, or all three of the illumination patterns 122, 124, and 808 can be, in some embodiments, within minus five decibels (−5 dB), minus eight decibels (−8 dB), minus ten decibels (−10 dB), minus twelve decibels (−12 dB), or minus fifteen decibels (−15 dB) relative to the gain at the center 144 of the face 140 of the intermediate reflector 108.

As still another example, each of the illumination patterns 122, 124, and 808 can have a predetermined, uniform shape. For example, the shapes of all three of the illumination patterns 122, 124, and 808 on the face 140 of the intermediate reflector 108 can be substantially circular, oval, or the like.

Figure 9A:
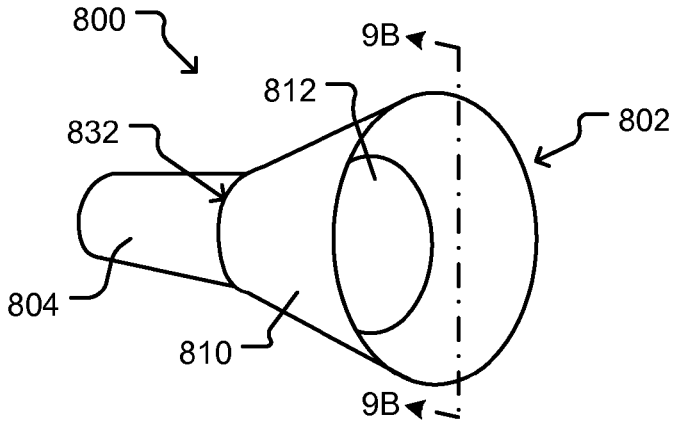
FIG. 9A illustrates an example of the tri-band feed horn of the reflector antenna system of FIG. 8A according to some embodiments of the invention.
Figure 9B:
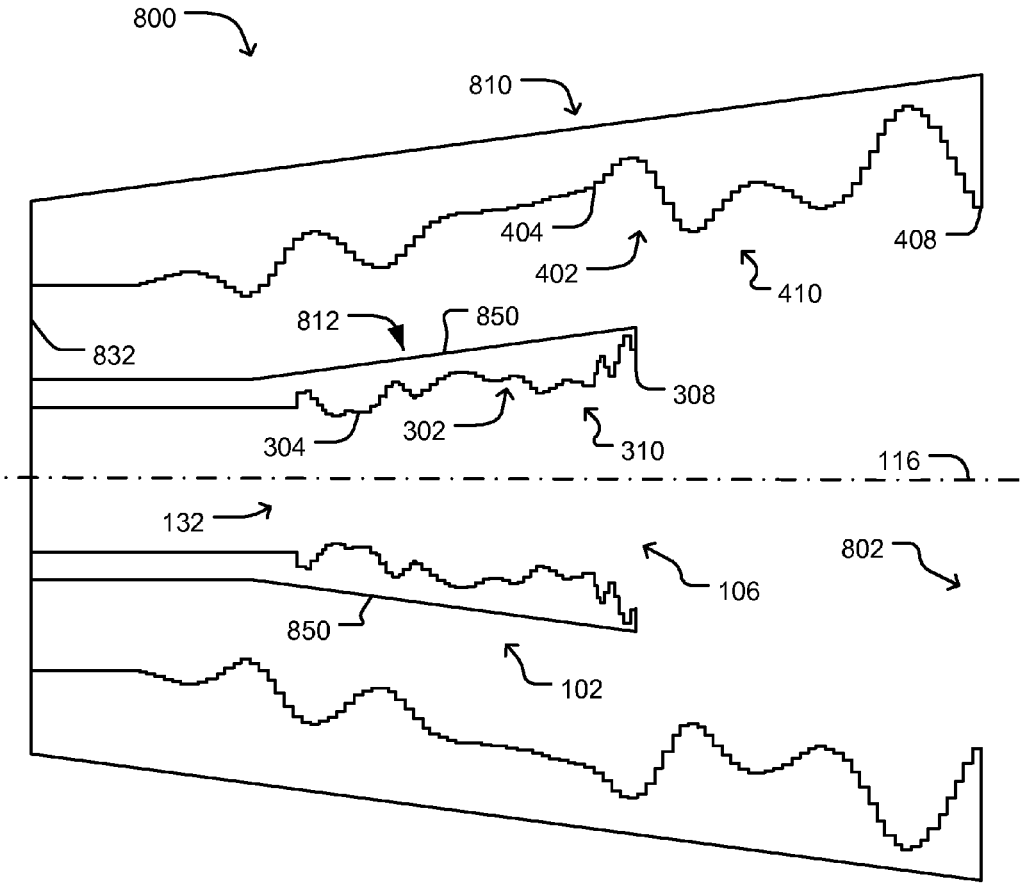
FIG. 9B is a cross-sectioned, side view of the tri-band feed horn of FIG. 8A.

The tri-band horn 800 with input 832 and output 802 can be configured to impart one or more of the foregoing characteristics of the illumination patterns 122, 124, and 808 despite one or more of the above-identified differences in the frequencies of the RF signals 118, 120, and 806. FIGS. 9A and 9B illustrate an example of the tri-band horn 800.

As can be seen in FIGS. 9A and 9B, the tri-band horn 800 can comprise an inner horn 812 and an outer horn 810. The inner horn 812 can be configured like the horn 102 discussed above. (Hereinafter, the inner horn is illustrated and discussed as being the same as the horn 102, which can thus handle the first RF signal 118 and the second RF signal 120 as discussed above. Hereinafter, the inner horn 812 is thus referred to with the numerical identifier 102.) As shown, the inner horn 102 can be disposed at least partially within the outer horn 810. In some embodiments, the outer horn 810 can be a single-band horn configured to transmit and/or receive the third RF signal 806.

As shown, the inner horn 102 can be disposed inside the outer horn 810. The inner horn 102 and the outer horn 810 can be concentrically arranged, with the both horns 102 and 810 being coaxially oriented about the central axis 116. The outer horn 810 can be larger than the inner horn 102 and can have a longer length and a wider output aperture 408.

As discussed above, the irregular and/or aperiodic profile 310 of the inner geometry 302 of the inner horn 102 (comprising features 304) can produce a substantially Gaussian or quasi-Gaussian beam profile of the first RF signal 118 and the second RF signal 120 at or near the output aperture 308 of the horn 102. The inner geometry 402 of the outer horn 810 can similarly have an irregular and/or aperoidic profile 410 comprising features 404 that produces a substantially Gaussian or quasi-Gaussan beam profile of the third RF signal 806 at or near the output aperture 308 of the outer horn 810. The profile 410 of the inner geometry 402 of the outer horn 810 can be as needed to produce the aforementioned beam characteristics and can thus be different than the profile 310 of the inner horn 102. Otherwise, the inner geometry 402 and the features 404 that compose the inner geometry 402 can be generally the same as the inner geometry 302 and features 304 of the inner horn 102 as discussed above. That is, the features 404 can consist of any of the types of features discussed above with respect to features 304.

Alternatively, the inner geometry 402 having the profile 410 comprising irregular and/or aperiodic features 404 can be on an outer surface 850 of the inner horn 102. That is, a functional equivalent of the profile 402 shown in FIG. 9B can instead be on an outer surface 850 of the inner horn 812. As yet another alternative, both the inner surface of the outer horn 810 and the outer surface 850 of the inner horn 850 can be configured with the functional equivalent of the profile 402.

As discussed above, the profile 310 of the inner geometry 302 of the inner horn 102 can generate modes (e.g., higher order modes) from the fundamental mode of the first RF signal 118 that combine with the fundamental mode of the first RF signal 118 to produce a substantially Gaussian or quasi-Gaussian beam at or near the output aperture 308 of the inner horn 102 from the first RF signal 118, and the profile 310 can also generates modes (e.g., higher order modes) from the fundamental mode of the second RF signal 120 that combine with the fundamental mode of the second RF signal 120 to produce a substantially Gaussian or quasi-Gaussian beam at the aperture 308 of the inner horn 102 from the second RF signal 118. The profile 410 of the inner geometry 402 of the outer horn 810 (which can alternatively or in addition be part of an outer surface 850 of the inner horn 102 as discussed above) can similarly be configured to generate modes (e.g., higher order modes) from the fundamental mode of the third RF signal 806 that combine with the fundamental mode of the third RF signal 806 to produce a substantially Gaussian or quasi-Gaussian beam at the aperture 802 of the outer horn 810 from the third RF signal 806. The Gaussian or quasi-Gaussian beams produced from the first RF signal 118, the second RF signal 120, and the third RF signal 806 can produce the illumination patterns 122, 124, and 808 on the face 140 of the intermediate reflector 108 having one or more of the characteristics discussed above.

In addition, the substantially Gaussian or quasi-Gaussian nature of the beams produced from the RF signals 118, 120, and 806 along with the physical and functional separation of the inner horn 102 from the outer horn 810 can prevent the first RF signal 118 and the second RF signal 120 from substantially combining with the third RF signal 806 in the tri-band horn 800. The fact that the beams produced in the inner horn 102 from the first RF signal 118 and the second RF signal 120 and the beam produced in the outer horn 810 from the third RF signal 806 are substantially Gaussian or quasi-Gaussian can prevent the beams from the first RF signal 118 and the second RF signal 120 from substantially combining with the beam produced from the third RF signal 806 from combing. This is because substantially Gaussian or quasi-Gaussian beams resist wide field spreading. If the beams were other than substantially Gaussian or quasi-Gaussian, the beams could spread widely in the tri-band horn 800 and thereby substantially interact (e.g., combine or partially combine), which could cause excessive signal distortion that could significantly affect the performance of the tri-band horn 800. Because the beams produced in the tri-band horn 800 are substantially Gaussian or quasi-Gaussian, however, the beams produced in the tri-band horn 800 from the RF signals 118, 120, and 806 do not substantially combine in the tri-band horn 800. The physical and functional separation between the inner horn 102 and the outer horn 810 can also permit independent optimization of the inner horn 102 and the outer horn 810, making optimization of the overall tri-band horn 800 feasible.

Figure 10:
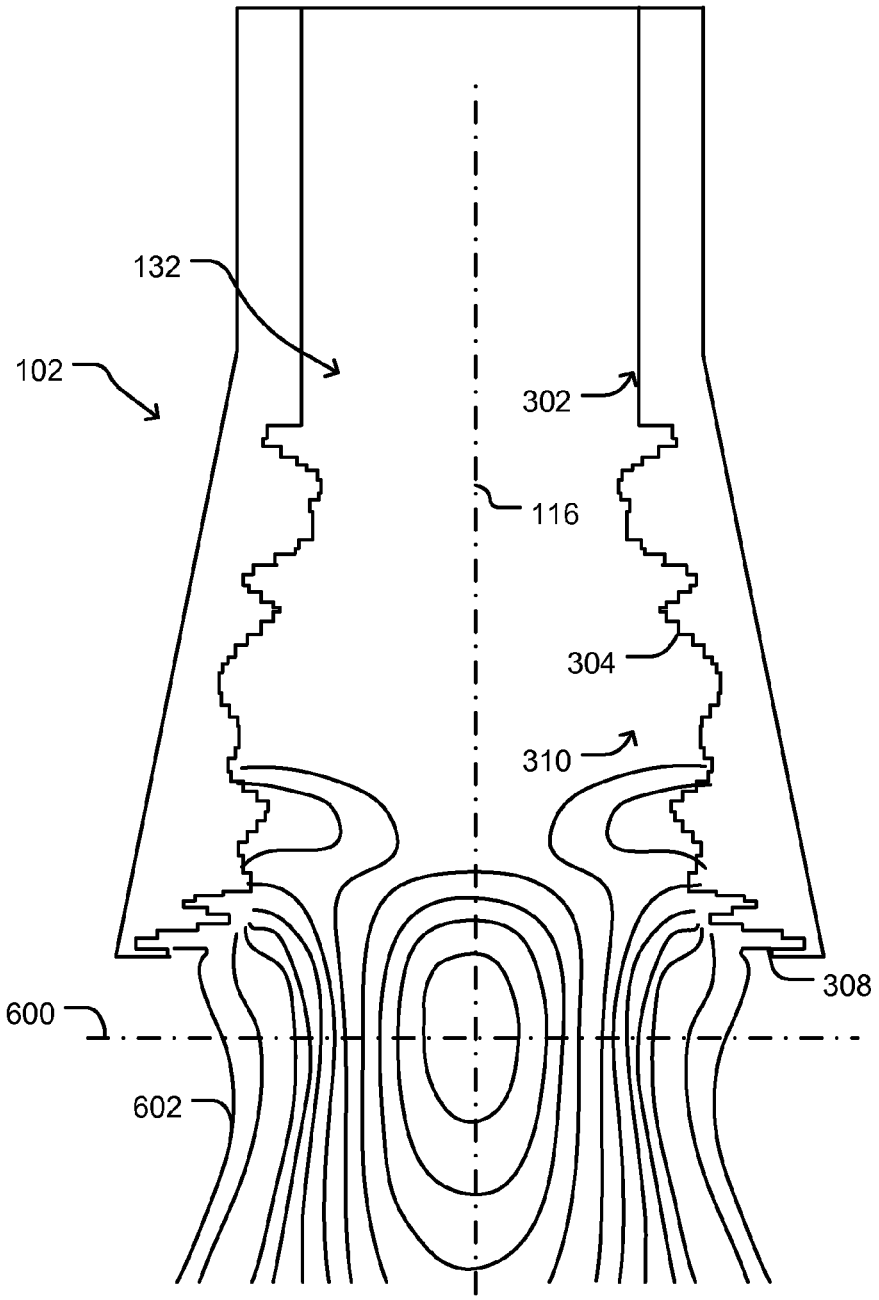
FIG. 10 is a cross sectioned view of the inner horn of the tri-band feed horn of FIGS. 9A and 9B producing a Gaussian beam with its waist outside of the output aperture of the horn according to some embodiments of the invention.
Figure 11:
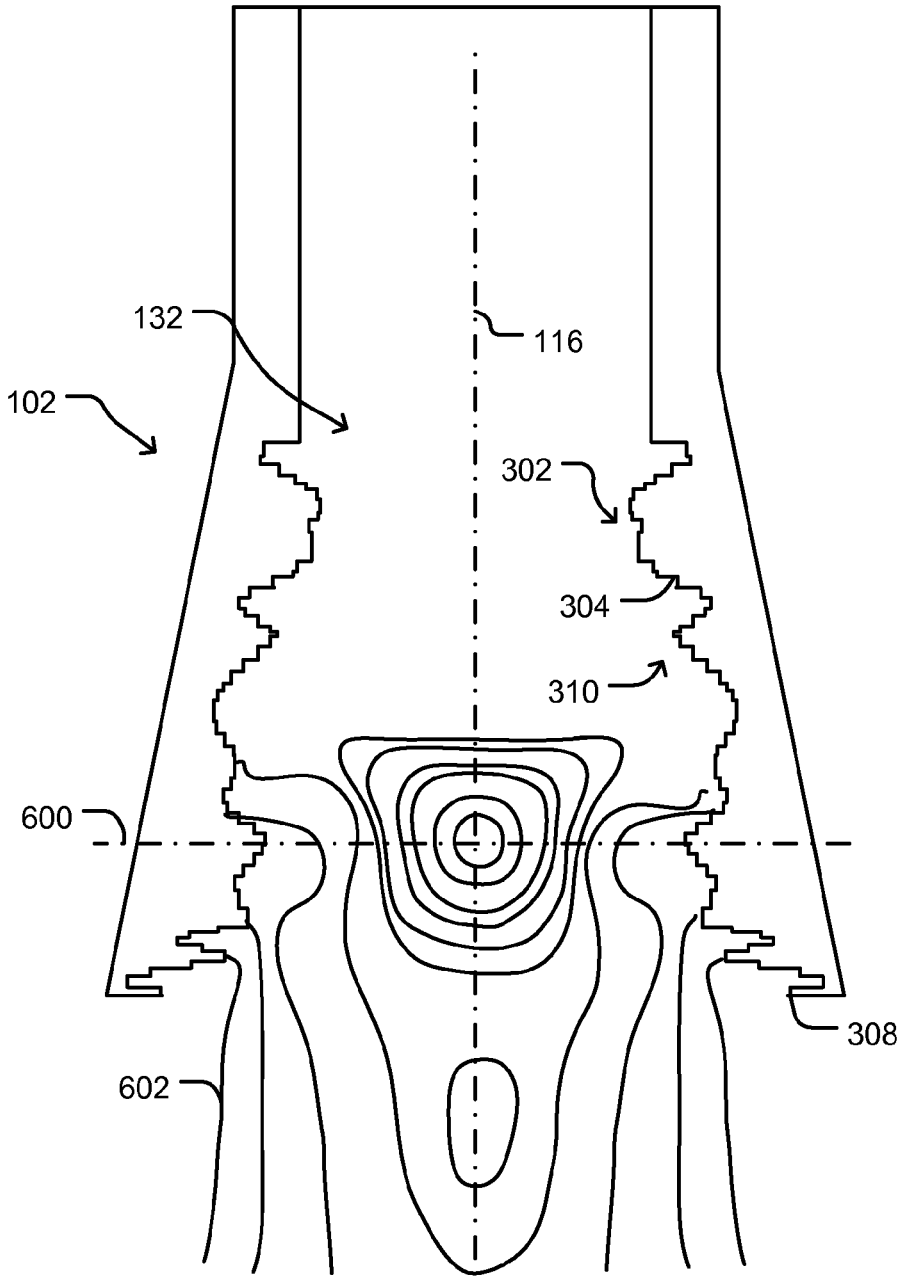
FIG. 11 is a cross sectioned view of the inner horn of the tri-band feed horn of FIGS. 9A and 9B producing a Gaussian beam with its waist inside of the output aperture of the horn according to some embodiments of the invention.

In addition to the above discussed characteristics of the inner horn 102, the inner horn 102 can also be configured to place the waist of the substantially Gaussian or quasi-Gaussian beams produced in the inner horn 102 from the first RF signal 118 and the second RF signal 102. FIGS. 10 and 11 illustrate examples.

FIG. 10 illustrates an example in which the profile 310 of the inner geometry 302 of the inner horn 102 is configured not only to produce a substantially Gaussian or quasi-Gaussian beam at the aperture 308 of the inner horn 102 but also to place the waist 600 of the beam at a desired location outside of the aperture 308. In FIG. 10, the formation of a substantially Gaussian or quasi-Gaussian beam is illustrated by contour lines of constant electric-field intensity 602, which illustrate areas of high gradients and areas of lower gradients. As shown, the waist 600 of the Gaussian beam is located distally (i.e., in front of) from the output aperture 308 of the inner horn 102. This placement or movement of the waist 600, which can otherwise be positioned at the aperture 308 of the horn 102, can be configured by the profile 310 of the inner geometry 302 of the inner horn 102. That is, not only, as discussed above, can the profile 310 of the inner geometry 302 be configured to generate modes (e.g., higher order modes) that combine with the fundamental mode of the first RF signal 118 or the second RF signal 120 in the inner horn 102 to produce substantially Gaussian or quasi-Gaussian beams at the aperture 308 of the inner horn, the profile 310 of the inner geometry 302 can also be configured to generate the modes such that the combination of the modes and the fundamental mode place the waist 600 in any of the positions disclosed and discussed herein. The profile 310 can be designed as discussed above.

Positioned outside the aperture 308 of the inner horn 102 as shown in FIG. 10, the waist 600 can cause the substantially Gaussian or quasi-Gaussian beam to be initially directed inwards towards the central axis 116 of the horn 102, as the beam leaves the aperture 308. After the beam passes the waist 600, the beam can begin to flair outwardly as shown. It will be understood that locating the waist 600 in front of the aperture 308, as shown, can be beneficial to the inner horn 102 of a tri-band horn 800, such as that shown in FIGS. 9A and 9B. Particularly, this positioning can minimize interaction of a beam produced in the inner horn 102 from the RF signals 118 or 120 that exits the aperture 308 of the inner beam 102 with a beam produced in the outer horn 810 from the third RF signal 806. If the waist 600 is not positioned in front of the output aperture 308, the beams exiting the inner horn 102 could be more likely to spread out and interact with the beam produced in the outer horn 810, reducing the overall performance of the tri-band horn 800.

It is noted that the waist 600 need not be moved outside the inner horn 102 as illustrated in FIG. 10 but can alternatively be moved inside the inner horn 102 such that the waist 600 is proximal or behind the aperture 308 as shown in FIG. 11. As shown, when the waist 600 is located behind the aperture 308, the directed beam can immediately spread outwardly as it passes through the aperture 308.

Turning now to the outer horn 410, the inner geometry 402 of the inner surface 404 of the outer horn 410 can be designed to produce the same or similar characteristics as the inner geometry 302 produces for the inner horn 102. For example, the geometry 402 of the inner surface 404 can be configured to produce modes (e.g., higher order modes) that combine with the fundamental mode of the signal in the outer horn 410 to produce one or more of the following characteristics: a substantially Gaussian or quasi-Gaussian profile at or near the output aperture 308 of the horn 410; the signal produces substantially the same illumination pattern on the reflector 110 as the signals in the inner horn 100; the illumination pattern produced on the face 140 of the intermediate reflector 108 by the signal in the outer horn 410 has an intensity at the outer edge 142 of the intermediate reflector 108 that is at least −8 dB, −10 dB, −12 dB, −15 dB, or less compared to the intensity at the center 144 of the intermediate reflector 108. In addition, the waist (like waist 600) of the Gaussian beam produced at the aperture 408 of the outer horn 410 can be moved generally as discussed above with respect to waist 600.

In fact, various configurations of the horn 800 of FIGS. 9A and 9B can permit the alignment of the waist of beams from both the inner 100 and the outer 410 horns. For example, in some embodiments, the waist 600 of signals 118, 120 directed by the inner horn 102 are aligned at the aperture 308 of the inner horn 102 and the waist (not shown but similar to 600) of the RF signal 806 directed by the outer horn 410 can be aligned with each other. This alignment can be to the left or the right of the aperture 308 of the inner horn 102 in FIGS. 9A and 9B and/or to the left or the right of the aperture 408 of the outer horn 410.

The tri-band horn 800 can be entirely air filled and thus have no dielectric material within the interior of the inner horn 102 and the outer horn 810, including no dielectric rod or lining. Without dielectrics, the tri-band horn 800 can operate at high power levels, such as up to kilowatt (kW) levels (e.g., at least 1 kW, 5 kWs, or higher) without burning up.

From the foregoing, it can be seen that the tri-band horn 800 can be configured such that RF signals in three different frequency bands exit the output aperture 408 of the tri-band horn 800 with minimal interaction. This design approach can rely on using aperture field targets computed from Gaussian cross-sectional field patterns at positions away from the waist of the fundamental Gaussian beam mode. For the inner horn 102, this can be done at each frequency band covered by the inner horn 102 and optimized together to produce a waist 600 in an RF spot in front of the inner horn 102. This can involve the optimization target fields to be computed ahead of the Gaussian beam waist. After this RF spot produces an effective RF extension of the phase center and produces functional separation between the inner horn 102 and the outer horn 810, the outer horn 810 can then be optimized using its own Gaussian beam target. It is also possible in this case to use a post-waist cross-sectional target to produce a low band RF spot inside the outer horn 810. This can be done to move the phase center of the outer horn 810 to match the phase center of the inner horn 102. Such co-aligned beam waists can assist to produce the same illumination pattern on the face 112 of the reflector 110, which can increase tri-band horn efficiency and improve power capability and signal performance.

The profile 310 of the inner geometry 302 of the inner horn 102 and the profile 410 of the inner geometry 402 of the outer horn 810 can be designed using one or more computational electromagnetics and/or one or more optimization processes. These processes will be described with reference to FIG. 12.

Figure 12:
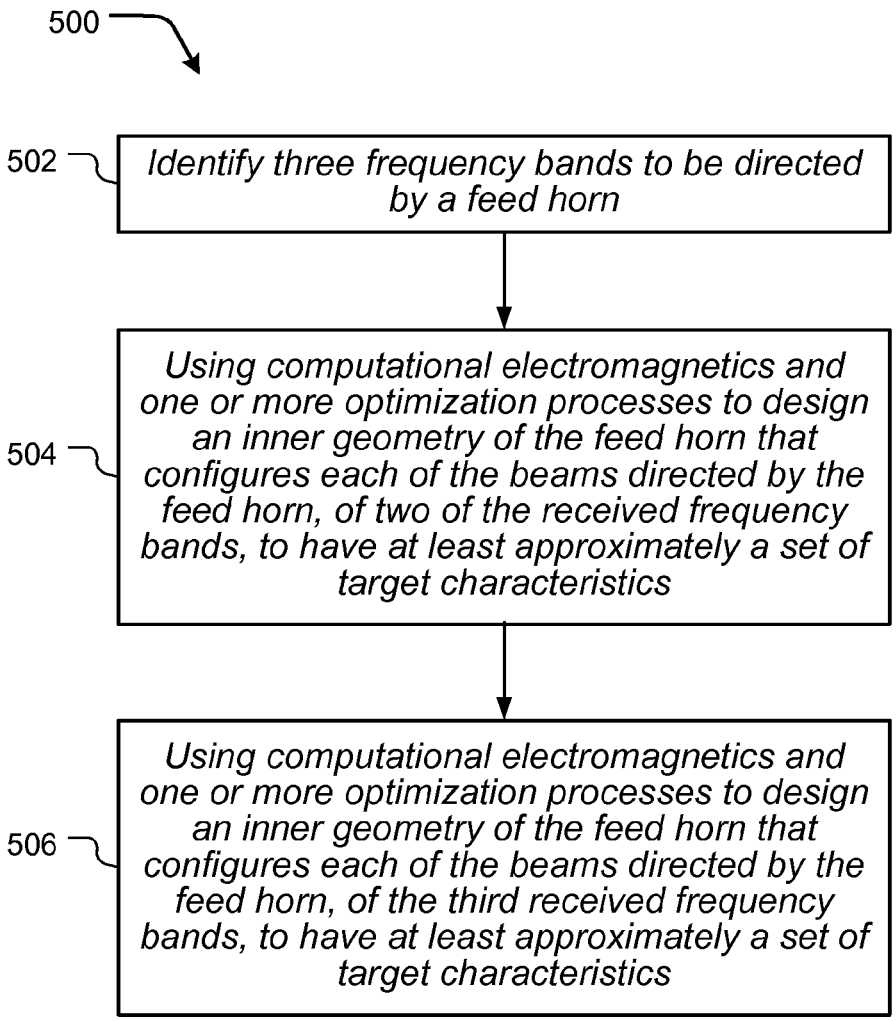
FIG. 12 is flowchart of a method for designing the profiles of the inner geometries of the inner horn and the outer horn of the tri-band horn of FIGS. 9A and 9B according to some embodiments of the invention.

FIG. 12 illustrates a method 500 of designing the profile 310 of the inner geometry 302 of the inner horn 102 and the profile 410 of the inner geometry 402 of the outer horn 810 of the tri-band horn 800. In step 502 of the method 500, three different frequency bands to be covered by the tri-band horn 800 are identified. This can be similar to step 202 of FIG. 6, as described above. The identified frequency bands can include any of the frequency bands identified above. In some embodiments, two frequency bands can be covered by the inner horn 102 and one by the outer horn 810.

Turning again to FIG. 12, in step 504, the profile 310 of the inner geometry 302 of the inner horn 102 can be designed. This step can utilize computational electromagnetics and/or one or more optimization processes, as previously described generally as described above with regard to step 204 of FIG. 6. In step 506, the profile 410 of the inner geometry 402 of the outer horn 810 can be designed. This step can be similar to step 204 of FIG. 6, which as discussed above can utilize one or more computational electromagnetics and/or one or more optimization processes.

As noted above, although the tri-band horn 800 is illustrated and discussed above as handling three RF signals 118, 120, and 806 in three different frequency bands, the horn 800 can be configured to handle more than three RF signals in more than three different frequency bands. For example, the outer horn 810 can be configured, like the inner horn 102, to handle two RF signals in two different frequency bands. Such a configuration of the tri-band horn 800 would be capable of handling four RF signals in four different frequency bands.

Figure 13:
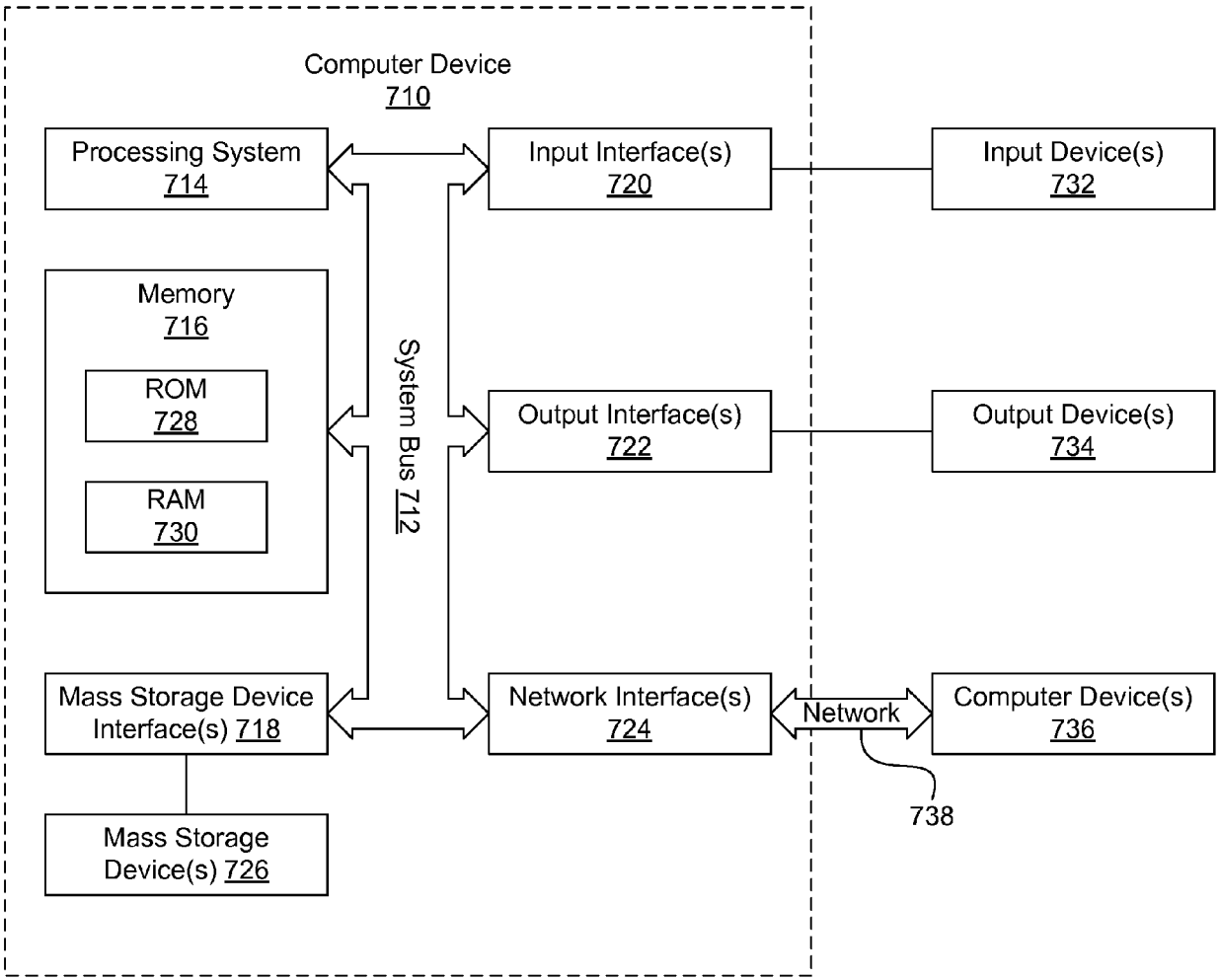
FIG. 13 is a representative computer system for designing the profile of the inner geometry of horns according some embodiments of the invention.

Reference will now be made to FIG. 13, which illustrates a suitable design environment in which embodiments of the invention directed to processes of designing a horn may be implemented. One skilled in the art will appreciate that embodiments of the invention may be practiced by one or more computing devices and in a variety of system configurations, including in a networked configuration. However, while the methods and processes of the invention have proven to be particularly useful in association with a system comprising a general purpose computer, embodiments of the invention include utilization of the methods and processes in a variety of environments, including embedded systems with general purpose processing units, digital/media signal processors (DSP/MSP), application specific integrated circuits (ASIC), stand alone electronic devices, and other such electronic environments.

Embodiments of the invention embrace one or more computer-readable media, wherein each medium may be configured to include or includes thereon data or computer executable instructions for manipulating data. The computer executable instructions include data structures, objects, programs, routines, or other program modules that may be accessed by a processing system, such as one associated with a general-purpose computer capable of performing various different functions or one associated with a special-purpose computer capable of performing a limited number of functions. Computer executable instructions cause the processing system to perform a particular function or group of functions and are examples of program code means for implementing steps for methods disclosed herein. Furthermore, a particular sequence of the executable instructions provides an example of corresponding acts that may be used to implement such steps. Examples of computer-readable media include random-access memory ("RAM"), read-only memory ("ROM"), programmable read-only memory ("PROM"), erasable programmable read-only memory ("EPROM"), electrically erasable programmable read-only memory ("EEPROM"), compact disk read-only memory ("CD-ROM"), or any other device or component that is capable of providing data or executable instructions that may be accessed by a processing system. While embodiments of the invention embrace the use of all types of computer-readable media, certain embodiments as recited in the claims may be limited to the use of tangible, non-transitory computer-readable media, and the phrases "tangible computer-readable medium" and "non-transitory computer-readable medium" (or plural variations) used herein are intended to exclude transitory propagating signals per se.

More specific reference will now be made to FIG. 13, which illustrates a representative system for implementing embodiments of the invention includes computer device 710, which may be a general-purpose or special-purpose computer or any of a variety of consumer electronic devices. Non-limiting examples of computer devices 10 include one or more personal computer, laptop computer, supercomputer, high performance clusters, vector processors, parallel computers, and/or other suitable computer devices and systems.

Computer device 710 can include system bus 712, which may be configured to connect various components thereof and enables data to be exchanged between two or more components. System bus 712 may include one of a variety of bus structures including a memory bus or memory controller, a peripheral bus, or a local bus that uses any of a variety of bus architectures. Typical components connected by system bus 712 include processing system 714 and memory 716. Other components may include one or more mass storage device interfaces 718, input interfaces 720, output interfaces 722, and/or network interfaces 724, each of which will be discussed below.

Processing system 714 can include one or more processors, such as a central processor and optionally one or more other processors designed to perform a particular function or task. It is typically processing system 714 that executes the instructions provided on computer-readable media, such as on memory 716, a solid state drive, a magnetic hard disk, a removable magnetic disk, a magnetic cassette, an optical disk, or from a communication connection, which may also be viewed as a computer-readable medium.

Memory 716 can include one or more computer-readable media that may be configured to include or includes thereon data or instructions for manipulating data, and may be accessed by processing system 714 through system bus 712. Memory 716 may include, for example, ROM 728, used to permanently store information, and/or RAM 730, used to temporarily store information. ROM 728 may include a basic input/output system ("BIOS") having one or more routines that are used to establish communication, such as during start-up of computer device 710. RAM 730 may include one or more program modules, such as one or more operating systems, application programs, and/or program data.

One or more mass storage device interfaces 718 may be used to connect one or more mass storage devices 726 to system bus 712. The mass storage devices 726 may be incorporated into or may be peripheral to computer device 710 and allow computer device 710 to retain large amounts of data. Optionally, one or more of the mass storage devices 726 may be removable from computer device 710. Examples of mass storage devices include hard disk drives, magnetic disk drives, tape drives and optical disk drives. A mass storage device 726 may read from and/or write to a magnetic hard disk, a removable magnetic disk, a magnetic cassette, an optical disk, or another computer-readable medium. Mass storage devices 726 and their corresponding computer-readable media provide nonvolatile storage of data and/or executable instructions that may include one or more program modules such as an operating system, one or more application programs, other program modules, or program data. Such executable instructions are examples of program code means for implementing steps for methods disclosed herein.

One or more input interfaces 720 may be employed to enable a user to enter data and/or instructions to computer device 10 through one or more corresponding input devices 732. Examples of such input devices include a keyboard and alternate input devices, such as a mouse, trackball, light pen, stylus, or other pointing device, a microphone, a joystick, a game pad, a satellite dish, a scanner, a camcorder, a digital camera, and the like. Similarly, examples of input interfaces 720 that may be used to connect the input devices 732 to the system bus 712 include a serial port, a parallel port, a game port, a universal serial bus ("USB"), an integrated circuit, a firewire (IEEE 1394), or another interface. For example, in some embodiments input interface 720 includes an application specific integrated circuit (ASIC) that is designed for a particular application. In a further embodiment, the ASIC is embedded and connects existing circuit building blocks.

One or more output interfaces 722 may be employed to connect one or more corresponding output devices 734 to system bus 712. Examples of output devices include a monitor or display screen, a speaker, a printer, a multi-functional peripheral, and the like. A particular output device 734 may be integrated with or peripheral to computer device 710. Examples of output interfaces include a video adapter, an audio adapter, a parallel port, and the like.

One or more network interfaces 724 enable computer device 710 to exchange information with one or more other local or remote computer devices, illustrated as computer devices 736, via a network 738 that may include hardwired and/or wireless links. Examples of network interfaces include a network adapter for connection to a local area network ("LAN") or a modem, wireless link, or other adapter for connection to a wide area network ("WAN"), such as the Internet. The network interface 724 may be incorporated with or peripheral to computer device 710. In a networked system, accessible program modules or portions thereof may be stored in a remote memory storage device. Furthermore, in a networked system computer device 710 may participate in a distributed computing environment, where functions or tasks are performed by a plurality of networked computer devices.

Those skilled in the art will appreciate that embodiments of the invention embrace a variety of different system configurations. For example, in one embodiment the system configuration includes an output device (e.g., a multifunctional peripheral (MFP) or other printer/plotter, a copy machine, a facsimile machine, a monitor, etc.) that performs multi-colorant rendering. In another embodiment, the system configuration includes one or more client computer devices, optionally one or more server computer devices, and a connection or network communication that enables the exchange of communication to an output device, which is configured to perform multi-colorant rendering.

Figure 14:
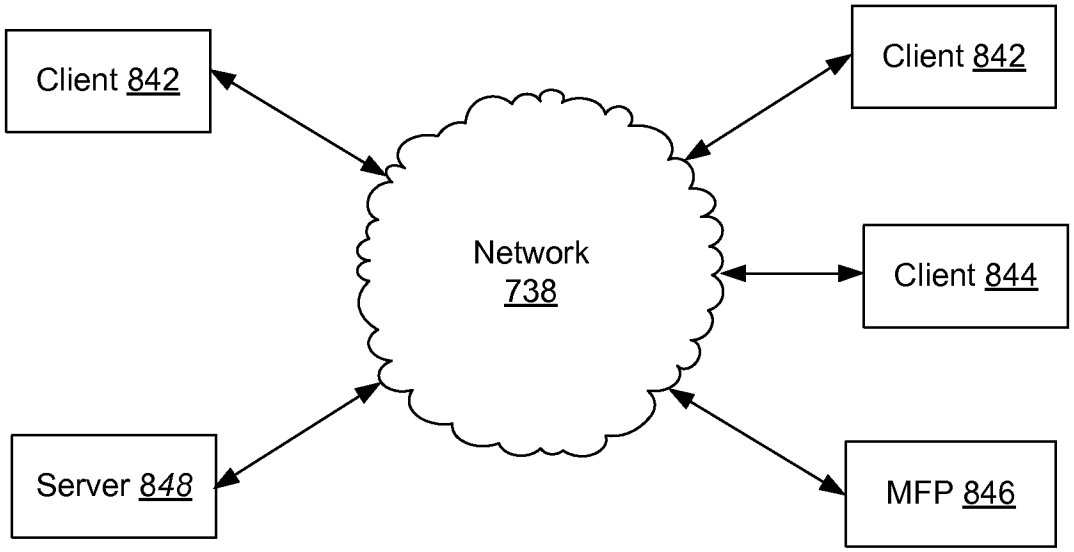
FIG. 14 is a representative networked system configuration for designing the profile of the inner geometry of horns according some embodiments of the invention.

Thus, while those skilled in the art will appreciate that embodiments of the invention may be practiced in a variety of different environments with many types of system configurations, FIG. 14 provides a representative networked system configuration that may be used in association with embodiments of the invention. The representative system of FIG. 14 includes a computer device, illustrated as client 840, which is connected to one or more other computer devices (illustrated as client 842 and client 844) and one or more peripheral devices (illustrated as multifunctional peripheral (MFP) MFP 846) across network 738. While FIG. 14 illustrates an embodiment that includes a client 840, two additional clients, client 842 and client 844, one peripheral device, MFP 846, and optionally a server 848, connected to network 738, alternative embodiments include more or fewer clients, more than one peripheral device, no peripheral devices, no server 848, and/or more than one server 848 connected to network 738. Other embodiments of the invention include local, networked, or peer-to-peer environments where one or more computer devices may be connected to one or more local or remote peripheral devices. Moreover, embodiments according to the invention also embrace a single electronic consumer device, wireless networked environments, and/or wide area networked environments, such as the Internet.

Similarly, embodiments of the invention embrace cloud-based architectures where one or more computer functions are performed by remote computer systems and devices at the request of a local computer device. Thus, returning to FIG. 14, the client 840 may be a computer device having a limited set of hardware and/or software resources. Because the client 840 is connected to the network 738, it may be able to access hardware and/or software resources provided across the network 738 by other computer devices and resources, such as client 842, client 844, server 848, or any other resources. The client 840 may access these resources through an access program, such as a web browser, and the results of any computer functions or resources may be delivered through the access program to the user of the client 840. In such configurations, the client 840 may be any type of computer device or electronic device discussed above or known to the world of cloud computing, including traditional desktop and laptop computers, smart phones and other smart devices, tablet computers, or any other device able to provide access to remote computing resources through an access program such as a browser.

Thus, as discussed herein, embodiments of the invention embrace a method for identifying the inner geometry of a multi-band horn as well as embracing a multi-band horn. Specifically, some embodiments embrace method for identifying the inner geometry of a dual-band horn and a tri-band horn. Some embodiments also embrace a dual-band horn and/or a tri-band horn.

Although specific embodiments and applications of the invention have been described in this specification, these embodiments and applications are exemplary only, and many variations are possible.

We claim:

1. A radio frequency (RF) horn comprising:

an input;

an output aperture;

an inner wall surface between the input and the output aperture, the inner wall surface comprising an inner geometry comprising irregular, aperiodic corrugations and/or undulations in a pattern that:

excites from a first signal introduced at the input additional modes that combine with a fundamental mode of the first signal such that the first signal has a substantially Gaussian beam profile at the output aperture, and excites from a second signal introduced at the input additional modes that combine with a fundamental mode of the second signal such that the second signal has a substantially Gaussian beam profile at the output aperture;

wherein a frequency of the first signal is different than a frequency of the second signal.

2. The horn of claim 1, wherein an illumination pattern of the first signal on an RF reflector antenna at which the horn is directed is substantially the same as an illumination pattern of the second signal on the reflector antenna.

3. The horn of claim 2, wherein:

an intensity of the illumination pattern of the first signal at an outer edge of the reflector is between eight decibels and fifteen decibels lower than the intensity of the illumination pattern of the first signal at a center of the reflector; and an intensity of the illumination pattern of the second signal at an outer edge of the reflector is between eight decibels and fifteen decibels lower than the intensity of the illumination pattern of the second signal at the center of the reflector.

4. The horn of claim 2, wherein:

gain profiles of the beam profile of the first signal through a first cross section and a second cross section of an output plane perpendicular to a central axis of the horn are substantially Gaussian, gain profiles of the beam profile of the second signal through the first cross section and the second cross section are substantially Gaussian, and the first cross section is rotated at least forty-five degrees from the second cross section such that the beam profile of the first signal and the beam profile of the second signal are generally rotationally symmetric.

5. The horn of claim 1, wherein a difference between the frequency of the first signal and the frequency of the second signal is at least ten percent.

6. The horn of claim 1, wherein a difference between the frequency of the first signal and the frequency of the second signal is at least one gigahertz.

7. The horn of claim 1, wherein the frequency of the first signal and the frequency of the second signal are each in a different one of the following frequency bands: L-band, S-band, C-band, X-band, Ku-band, K-band, Ka-band, Q-band, V-band, E-band, and W-band.

8. The horn of claim 1, wherein the frequency of the first signal is in a K-band, and the frequency of the second signal is in Ka-band.

9. The horn of claim 1, wherein an interior of the horn is air filled and lacks dielectric material.

10. A method of projecting a first signal and a second signal onto a radio frequency (RF) reflector antenna, the method comprising:

introducing into a horn a first RF signal at a first frequency;

exciting with an inner geometry comprising irregular, aperiodic corrugations and/or undulations on an interior surface of the horn additional modes of the first signal that combine with a fundamental mode of the first signal such that the first signal has a substantially Gaussian beam profile at an output aperture of the horn;

introducing into the horn a second RF signal at a second frequency different than the first frequency; and exciting with the inner geometry of the horn additional modes of the second RF signal that combine with a fundamental mode of the second signal such that the second signal has a substantially Gaussian beam profile at the output aperture of the horn.

11. The method of claim 10 further comprising directing the output aperture of the horn at the RF reflector antenna to project a first illumination pattern from the first signal onto the reflector antenna and a second illumination pattern from the second signal onto the reflector.

12. The method of claim 11, wherein the first illumination pattern and the second illumination pattern are substantially the same on the reflector antenna.

13. The method of claim 11, wherein:

an intensity of the first illumination pattern at an outer edge of the reflector is at least ten decibels lower than the intensity of the first illumination pattern at a center of the reflector; and an intensity of the second illumination pattern at the outer edge of the reflector is at least ten decibels lower than the intensity of the second illumination pattern at the center of the reflector.

14. The method of claim 10, wherein a difference between the first frequency and the second frequency is at least ten percent of the first frequency.

15. The method of claim 10, wherein a difference between the first frequency and the second frequency is at least one gigahertz.

16. The method of claim 10, wherein the first frequency and the second frequency are each in a different one of the following frequency bands: L-band, S-band, C-band, X-band, Ku-band, K-band, Ka-band, Q-band, V-band, E-band, and W-band.

17. The method of claim 10, wherein the first frequency is in a K-band, and the second frequency is in a Ka-band.

18. A method of designing an inner geometry of a multi-band horn utilizing a computer programmed to perform a method comprising:

the programmed computer receiving at least two frequency bands to be directed by a horn; and the programmed computer using computational electromagnetics and one or more optimization processes to generate an inner geometry of a horn that configures each of the beams directed by the horn, of the two or more frequency bands, to have at least approximately a set of target characteristics, including having a Gaussian aperture profile pattern and producing a fixed illumination pattern on a reflector at which the horn is directed.

19. The method of claim 18, wherein the programmed computer uses the computational electromagnetics and the one or more optimization processes to generate the inner geometry of the horn such that the fixed illumination pattern has a normalized gain of approximately a predetermined value at the edges of the reflector relative to the gain at the center of the reflector.

20. The method of claim 19, wherein the predetermined value is approximately negative ten decibels.

21. The method of claim 18, wherein the programmed computer uses the computational electromagnetics and the one or more optimization processes to generate the inner geometry of the horn such that the set of target characteristics includes a directed beam of a first frequency band of the selected frequency bands that has a realized gain of less than or equal to approximately one decibel relative to a directed beam of a second frequency band of the selected frequency bands.

22. The method of claim 18, wherein the programmed computer uses the computational electromagnetics and the one or more optimization processes to generate the inner geometry of the horn to include one or more aperiodic undulations.

23. The method of claim 18, wherein the horn includes a circular cross section, taken perpendicular to a central axis of the horn, and wherein the programmed computer uses the computational electromagnetics and the one or more optimization processes to generate the inner geometry of the horn at one or more inner wall surfaces of the horn.

24. The method of claim 18, wherein the programmed computer using the computational electromagnetics comprises the programmed computer using mode matching.

* * * * *